US007976001B2

(12) United States Patent
Ishii et al.

(10) Patent No.: US 7,976,001 B2
(45) Date of Patent: Jul. 12, 2011

(54) SHEET STACK CUTTER AND FINISHER HAVING THE SAME

(75) Inventors: Susumu Ishii, Kawasaki (JP); Hiroshi Fukumoto, Kawasaki (JP)

(73) Assignee: Seiko Ltd., Kawasaki-shi, Kanagawa (JP)

( * ) Notice: Subject to any disclaimer, the term of this patent is extended or adjusted under 35 U.S.C. 154(b) by 540 days.

(21) Appl. No.: 12/216,929

(22) Filed: Jul. 14, 2008

(65) Prior Publication Data

US 2009/0165625 A1 Jul. 2, 2009

(30) Foreign Application Priority Data

| | | |
|---|---|---|
| Dec. 28, 2007 | (JP) | 2007-340847 |
| Feb. 6, 2008 | (JP) | 2008-027058 |
| Feb. 6, 2008 | (JP) | 2008-027059 |
| Feb. 6, 2008 | (JP) | 2008-027060 |
| Feb. 6, 2008 | (JP) | 2008-027061 |
| Feb. 21, 2008 | (JP) | 2008-040382 |
| Feb. 29, 2008 | (JP) | 2008-050540 |

(51) Int. Cl.
*B26D 5/00* (2006.01)

(52) U.S. Cl. ..... 270/52.17; 270/58.07; 83/613; 83/459; 83/856

(58) Field of Classification Search ..... 270/52.17, 270/58.07, 5.02, 58.08; 83/613, 459, 856
See application file for complete search history.

(56) References Cited

U.S. PATENT DOCUMENTS

| | | | | |
|---|---|---|---|---|
| 2,866,503 | A * | 12/1958 | Townsend et al. | 83/143 |
| 5,740,710 | A * | 4/1998 | Gross et al. | 83/375 |
| 6,910,686 | B2 * | 6/2005 | Awano | 270/37 |
| 7,014,182 | B2 * | 3/2006 | Marsh | 270/58.07 |
| 7,328,893 | B2 * | 2/2008 | Kawatsu et al. | 270/58.09 |
| 7,413,360 | B2 * | 8/2008 | Kikuchi | 400/621 |
| 7,631,858 | B2 * | 12/2009 | Harada | 270/58.07 |
| 7,694,947 | B2 * | 4/2010 | Marsh | 270/58.07 |

FOREIGN PATENT DOCUMENTS

JP 10138194 A * 5/1998

* cited by examiner

*Primary Examiner* — Patrick Mackey
(74) *Attorney, Agent, or Firm* — Manabu Kanesaka

(57) ABSTRACT

A sheet stack cutter cuts sheet stacks by means of a moving cutter edge and a stationary cutter edge disposed upward and downward along a predetermined cutting-plane line. The sheet stack cutter includes a sheet loading table for supporting the sheet stack, a press device for pressing and holding the sheet stack on the sheet loading table, a moving cutter edge disposed in up and down cutting directions for cutting the sheet stack on the sheet loading table along the cutting-plane line, a stationary cutter edge disposed to the side of the sheet loading table for pressing the moving cutter edge to cut the sheet stack, and an apparatus frame furnished with the press device and the moving cutter edge. A drive device moves the moving cutter edge in up and down cutting directions.

9 Claims, 18 Drawing Sheets

Waiting position

Upper dead point

Seet stack pressing position

Cut-starting point

Cut-finishing point

Press releasing point

SHEET STACK CUTTER AND FINISHER HAVING THE SAME

BACKGROUND OF THE INVENTION AND RELATED ART STATEMENT

1. Field of the Invention

The present invention relates to a sheet stack cutter for cutting sheet stacks set on a sheet loading table, and an improvement of a sheet stack cutter which performs a set-justification on the sheets formed with images by an image forming apparatus into sheet stacks and performs a cutting-justification with previously determined cutting-plane lines.

2. Description of the Prior Art

In general, this kind of sheet stack cutter has widely been served as the cutter which sets the paper sheets on the sheet loading table and performs cuttings at the determined portions. For example, this apparatus is known as a trimming apparatus or a cutting apparatus, the trimming apparatus performing the set-justification to the sheets delivered from a printer into the stacks for book-binding and performing a cutting-justification to the book-bound sheet stacks around perimeters, and the cutting apparatus performing the cutting on the sheets from the image forming apparatus into ½ or ¼.

There have conventionally been known a cutting apparatus which sets one sheet of paper on a table and cuts it as disclosed in, for example, a patent document 1 (Japanese Patent Laid Open No. 10-138194), and a cutting apparatus which sets many sheets of papers in stack and cuts at once as disclosed in a utility model document 2 (Japanese utility model publication No. 47-8308). With regard to the cutting ways, as the patent document 1, the cutting is carried out with a cutter edge (rotating cutter edge) from one end to the other end, and as the utility model document 2, the cutting is carried out with a flat cutter edge (guillotine) moving down from the upper part of the sheet stack.

As the patent document 1, in the mechanism of cutting by traveling one sheet of cutter edge (rotary knife) from one end of the sheet to the other end, if cutting the sheet stack of many paper sheets at once, a shearing force acting to the cutter edge becomes large, and if traveling the cutter edge with a force exceeding it, a problem is known as occurrence of the cutter edge meandering. Therefore, for cutting one sheet or a few sheets of papers, the cutting mechanism of rotating cutter edge has been conventionally employed. Accordingly, it has been assumed to be impossible to carrying out the cutting of many sheets of papers.

As the utility model document 2, when cutting many sheets of papers at once by means of a vertically moving cutter edge (guillotine), the shearing energy required to cutting must be large. This is because by bringing down the cutter edge at high speed, the sheet stack is cut at its impulsive force, and in this case, the apparatus must be stoutly composed and a driving apparatus must be large-scaled.

The utility model document 2 and a utility model document 3 (Japanese utility model publication No. 52-103489) have proposed the devices for reducing dimensions of the driving mechanism for vertically bringing the plate shaped cutter edge. The documents pivot the plate shaped cutter edge onto a pair of left and right swinging arms in order to swing the cutter edge. By causing the vertically moving cutter edge to swing by the pair of arm members, when the cutter edge reaches a lower dead point (finishing posture of cutting), shock loading to the apparatus can be reduced. Therefore, it is not necessary to stoutly compose the apparatus. Further, the utility model document proposes to make the pair of left and right swinging arms have different lengths so that the cutter edge tilts with respect to the sheet surface in order to reduce cutting force.

When loading to hold the plural sheets of papers on the sheet loading table and cutting them, the guillotine cutting system disclosed in the utility model document 2 is known. Similarly to such a cutting apparatus, the apparatus cutting the sheet stack from one end to the other end of the cutting plane line as swinging the plate shaped cutter edge is known from the utility model documents 2 and 3.

In each of the above cutting apparatuses, it is necessary to provide a cutter edge receiving member or the stationary cutter edge to the side of the sheet loading table with respect to the moving cutter edge vertically moving in the cutting direction. The cutter edge receiving member is composed of a soft material, for example, a rubber material not to damage the edge of the movable cutter, and the stationary cutter has the edge sliding with the edge of the movable cutter like scissors.

Conventionally, in the cutting mechanism holding the sheet stack between the moving cutter edge and the stationary cutter edge, if a space is created between both cutting edges, the cutting is impossible and the sheets enter therebetween to cause bad action (cutting jam). In case of cutting the sheet stack as creating the space between the cutting edges, a known problem occurs of inferior cutting quality.

Therefore, the prior art has employed a mechanism that the moving cutter edge is urged by such as a spring in the direction crossing with the cutting in order to suppress the stationary cutter edge. However, when cutting the sheet stack, large force acts in the direction crossing with the cutting, so that the moving cutter edge gets away from the stationary cutter edge and the space occurs between the cutting edges. Accordingly, when the prior art urges the moving cutter edge to suppress the side of the stationary cutter edge with the urging force overcoming the escaping force occurring when cutting the sheet stack, and troublesome works are involved as repairing or changing the cutting edges.

An inventor of this invention has hinted to position the stationary cutter edge to be placed to the side of the sheet loading table by suppressing it with an urging spring when closely sliding the moving cutter edge and the stationary cutter edge, and under this condition, to position the stationary cutter edge with the pressing means of forcing the sheet stack toward the sheet loading table.

It is a main object of the invention to provide a sheet stack cutter enabling to always realize exact cuttings of a superior cutting quality without effecting an overload on the cutting edges when cutting the sheet stack with the moving cutter edge and the stationary cutter edge along a predetermined cutting plane line.

Further, it is another object of the invention to the sheet stack cutter of a simple structure at lower cost when closely sliding the moving cutter edge and the stationary cutter edge each other.

SUMMARY OF THE INVENTION

The invention cuts the sheet stack along the predetermined cutting-plane line by means of the moving cutter edge and the stationary cutter edge disposed upward and downward. At this time, with respect to the moving cutter edge, the stationary cutter edge is supported to the apparatus frame movably back and forth in the plane direction (the sheet surface direction) and is urged to the side of the moving cutter edge by an urging means such as a compression spring. On the other hand, the press means which holds the sheet stack to be cut to the sheet loading table is composed of the pressure member, a pressure spring forcing the pressure member to the sheet stack, and a pressure releasing means retreating the pressure member above the sheet stack on the sheet loading table. The pressure member is disposed such that pressing force acts on the stationary cutter edge by the pressure spring. Thereby, if the pressure member is retreated above the sheet loading table for setting the sheet stack on the sheet loading table, the stationary cutter edge is closely pressed to the moving cutter edge by the urging means. Subsequently, if the set sheet stack is pressed by the pressure member, pressing force of the pressure member acts on the stationary cutter edge to fix it there. Accordingly, the moving cutter edge and the stationary cutter edge are held under the condition of being closely contacted each other, and it is possible to perform the cutting of the sheet stack by moving the moving cutter edge in the cutting direction.

DETAILED DESCRIPTION OF PREFERRED EMBODIMENTS

Figure 1:
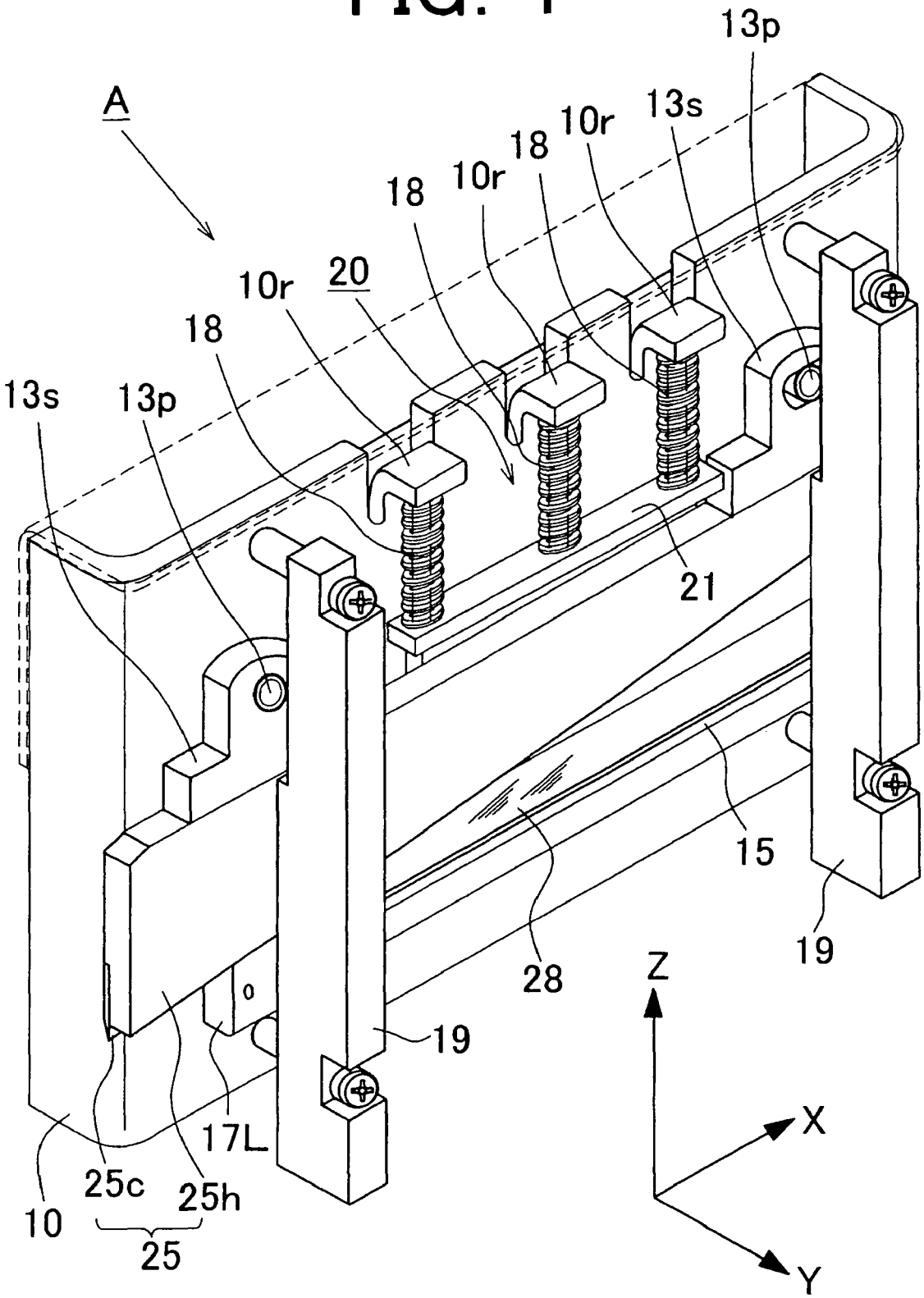
FIG. 1 is a perspective view showing the whole structure of the sheet stack cutting apparatus according to the invention.
Figure 2:
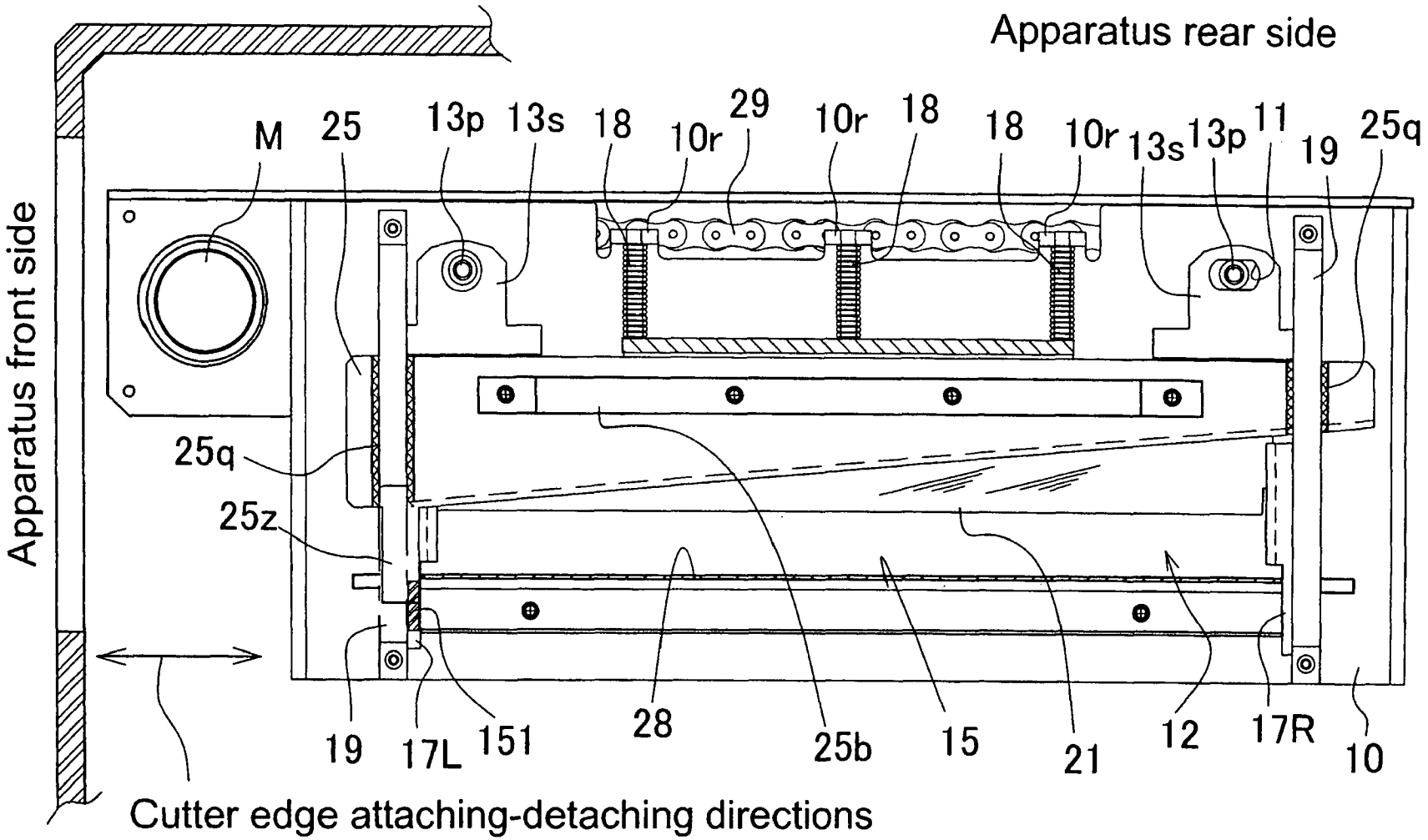
FIG. 2 is an explanatory view showing the front structure of the apparatus of FIG. 1.
Figure 3:
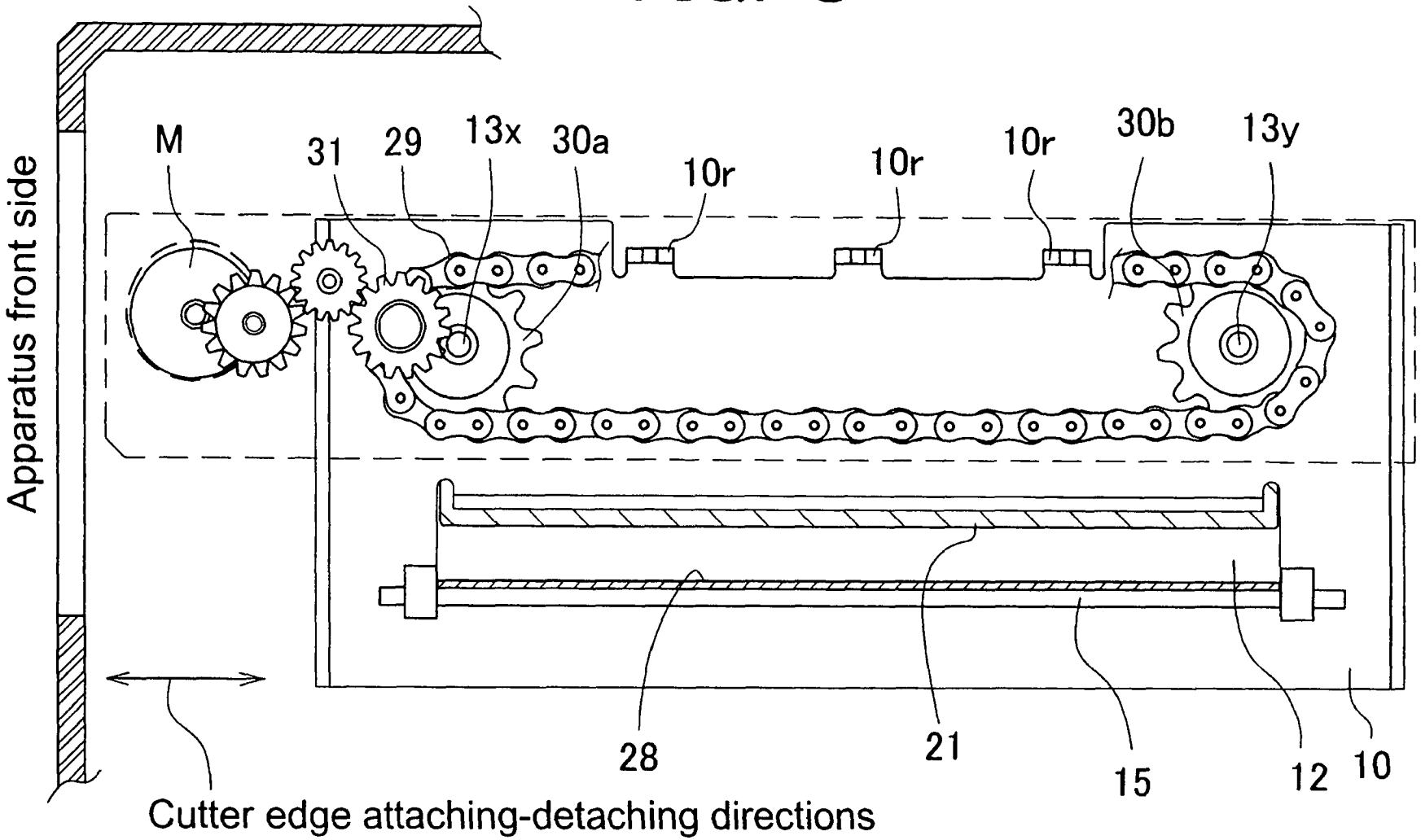
FIG. 3 is an explanatory view showing the backside structure of the apparatus of FIG. 1.
Figure 4:
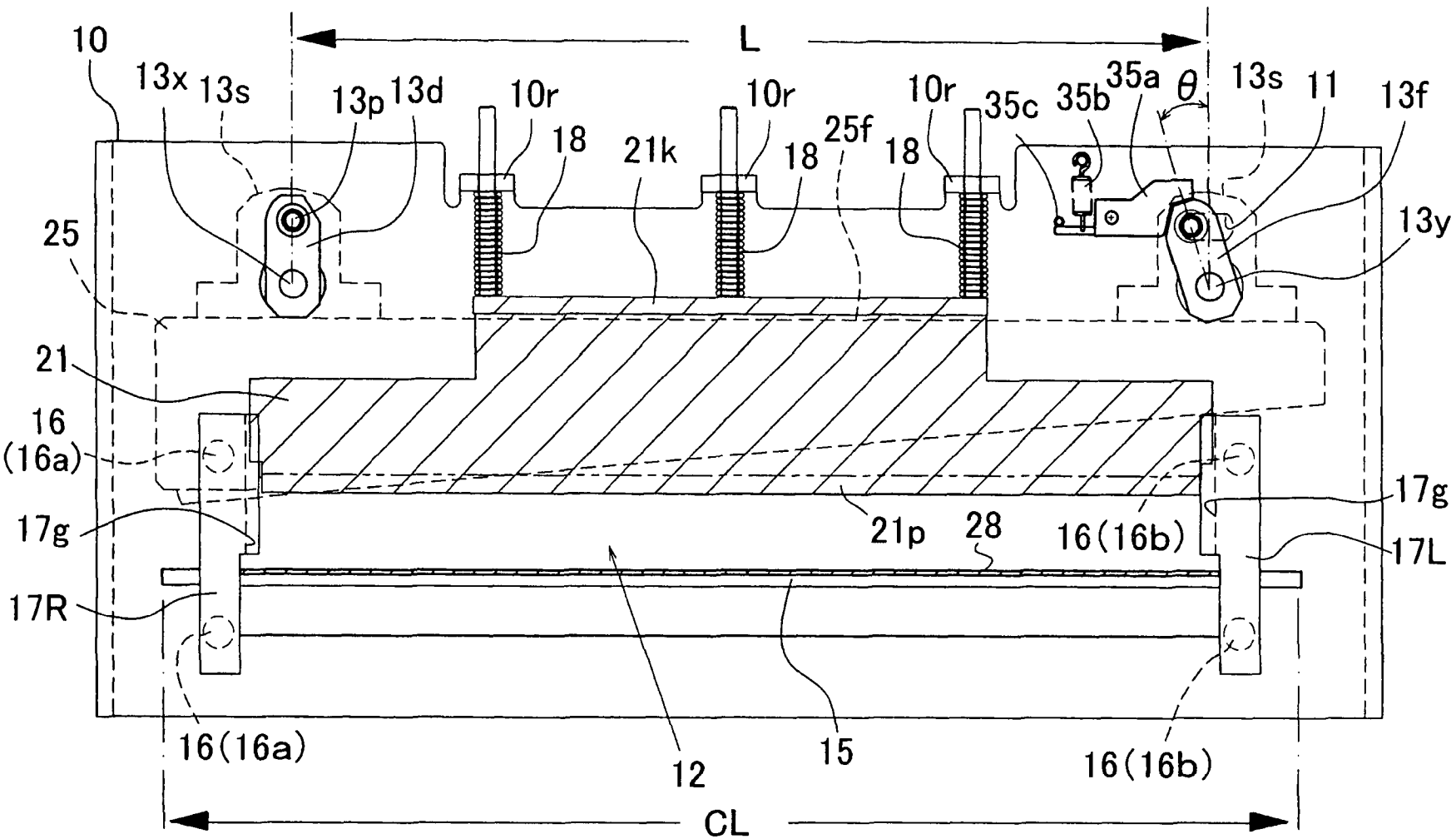
FIG. 4 is an explanatory view showing the structure of the cutting end pressing means in the apparatus of FIG. 1.

In the following, based on preferred embodiments, the invention will be referred to in detail. FIG. 1 is the perspective view showing the whole structure of the sheet stack cutting apparatus (trimmer unit) according to the invention, FIG. 2 is the front view thereof, FIG. 3 is the backside view of the apparatus of FIG. 1, and FIG. 4 is the view explaining showing the structure of the cutting end-pressing means.

A sheet stack cutting apparatus (trimmer unit) A shown in FIG. 1 is composed of a sheet loading table 15 of loading to support the sheet stack P thereon, a pressing means 20 of pressing to hold the sheet stack P on the same, a moving cutter edge 25 of cutting the sheet stack P along a predetermined cutting-plane line CL, and a stationary cutter edge 28 integrally furnished on the sheet loading table 15. These sheet loading table 15, pressing means 20 and moving cutter edge 25 are furnished to an apparatus frame (a later mentioned base plate) 10. Explanation will be made to each of the structures.

[Structure of the Apparatus Frame]

The above mentioned apparatus frame 10 mounts thereon the sheet loading table 15, moving cutter edge 25 and pressing means 20, and is composed of a steel plate of convenient thickness having, for example, mechanical strength in response to cutting of the sheet stack P. The apparatus frame 10 shown in FIG. 1 is composed of a base plate in plane shape arranged in a direction (an arrow Z direction; vertical direction) crossing with the sheet surface of the sheet stack P. The plane shaped base plate (apparatus frame) is provided with a cutting open 12 for supplying or discharging the sheet stack P, and with respect to this cutting open 12, a later mentioned sheet loading table 15 is arranged in a crossing direction (an arrow Y direction). The base plate 10 is disposed with a pair of left and right drive rotation members 13*d*, 13*f* (when naming both generically, "13" will be given) for supporting the moving cutter edge 25 at the front side, and with a transmission chain 29 for synchronously rotating the pair of drive and rotation members 13 at the rear side (details will be mentioned later).

[Structure of the Sheet Loading Table]

Figure 9:
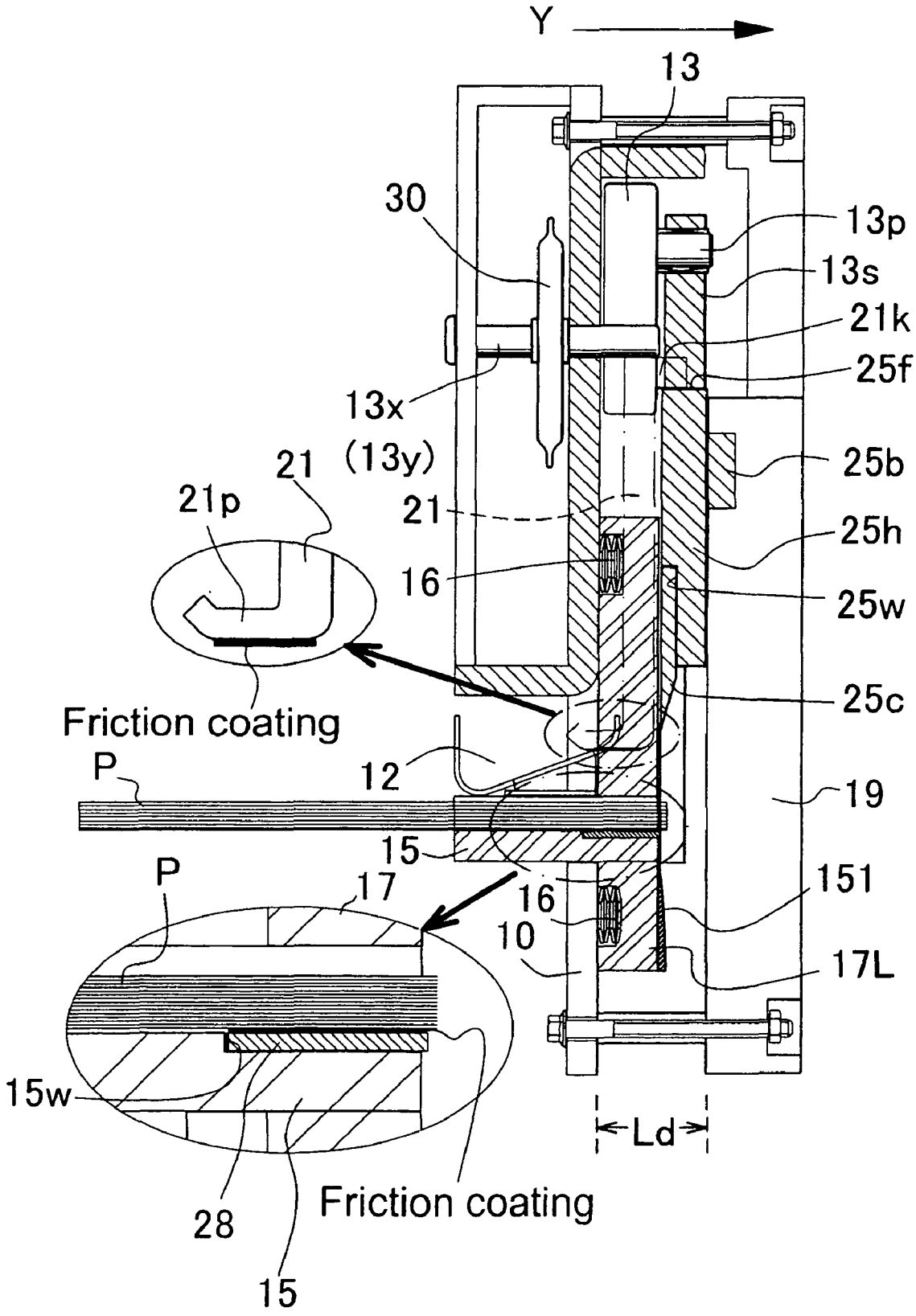
FIG. 9 is an explanatory view of a structure in vertically cross section of the apparatus of FIG. 1.

The above mentioned base plate 10 is attached at the cutting open 12 with the sheet loading table 15 having the stationary cutter edge 28. The sheet loading table 15 is composed of a mounting member such as a tray for holding the sheet (or the sheet stack) to be cut at a determined posture. A shape of the posture is enough with either of the shapes of mounting to support the whole of the sheet stack P or of supporting partially the cutting end of the sheet stack P as shown. The shown sheet loading table 15 is, as shown in FIG. 4, composed of a beam shaped member of a predetermined length along the cutting-plane line CL, and the beam member is attached integrally with the stationary cutter edge 28 to the cutting end along the cutting-plane line CL. In short, as shown in FIG. 9, the sheet loading table 15 is defined with a difference in step 15*w* along the cutting-plane line CL, and this difference in step 15*w* is fitted with the plate shaped stationary cutter edge 28 which is made of a sharp and tough material such as a carbon steel, cemented carbon steel or stainless steel.

On the sheet loading table 15, a pair of left and right guide members 17R, 17L (see FIG. 4) are provided by bolts along the cutting-plane line. The pair of left and right guide members 17R, 17L are formed with guide grooves 17*g* for vertically guiding the pressure plate 21.

[Positioning Mechanism of the Stationary Cutter Edge]

As mentioned above, the stationary cutter edge 28 furnished integrally on the sheet loading table 15 is separated from the base plate 10, and is urged to a later mentioned moving cutter edge 25 by means of urging means 16 (16*a*, 16*b*). The structure thereof will be explained referring to FIGS. 9 (the cross sectional view) and 10 (the disassembled view). On the sheet loading table 15, there are, as one body, provided the stationary cutter edge 28 and the pair of guide members 17R, 17L (called as "sheet loading table assembly 15" hereafter). The sheet loading table assembly 15 is fittingly supported movably in a direction crossing with cutting (an arrow direction of FIG. 9) to a cutting open 12 of the base plate 10. To the drive rotation members (a drive side) 13*d* and (a following side) 13*f* rotatably pivoted on the base plate 10, the moving cutter edge 25 is pivoted. The moving cutter edge 25 is composed of a cutter edge receipt holder 25*h* and the edge of a blade member 25*c*, and is fittingly supported to a transmission pin 13*p* of the drive rotation member 13 via a bearing sleeve 13*s*.

The guide members 17R, 17L and the moving cutter edge 25 are held between the base plate 10 and pressure member 19. The base plate 10 is secured with the pressure member 19 (a pair of left and right stay members are shown) by bolts with a space Ld. Between the base plate 10 and the pressure member 19, the guide members 17R, 17L and the moving cutter edge 25 are supported (see FIG. 9). At this time, between the base plate 10 and the guide members 17R, 17L, the urging means 16 (16*a*, 16*b*) composed of the compression spring is provided as suppressing the guide members 17R, 17L to the moving cutter edge 25. Accordingly, the stationary cutter edge 28 integrated with the guide members 17R, 17L is always suppressed and urged to the moving cutter edge 25. The urging means 16 (16*a*, 16*b*) are not limited to the shown spring but enough with a spacer of a suppressing member of a sponge or rubber.

The moving cutter edge 25 sliding in vertical directions between the base plate 10 and the pressure member 19 is coated with a lubrication coating 25*q* as shown in FIG. 2. By this lubrication coating 25*q*, the moving cutter edge 25 smoothly slides and vertically moves in relation with the pressure member 19.

Figures 11A, 11B:
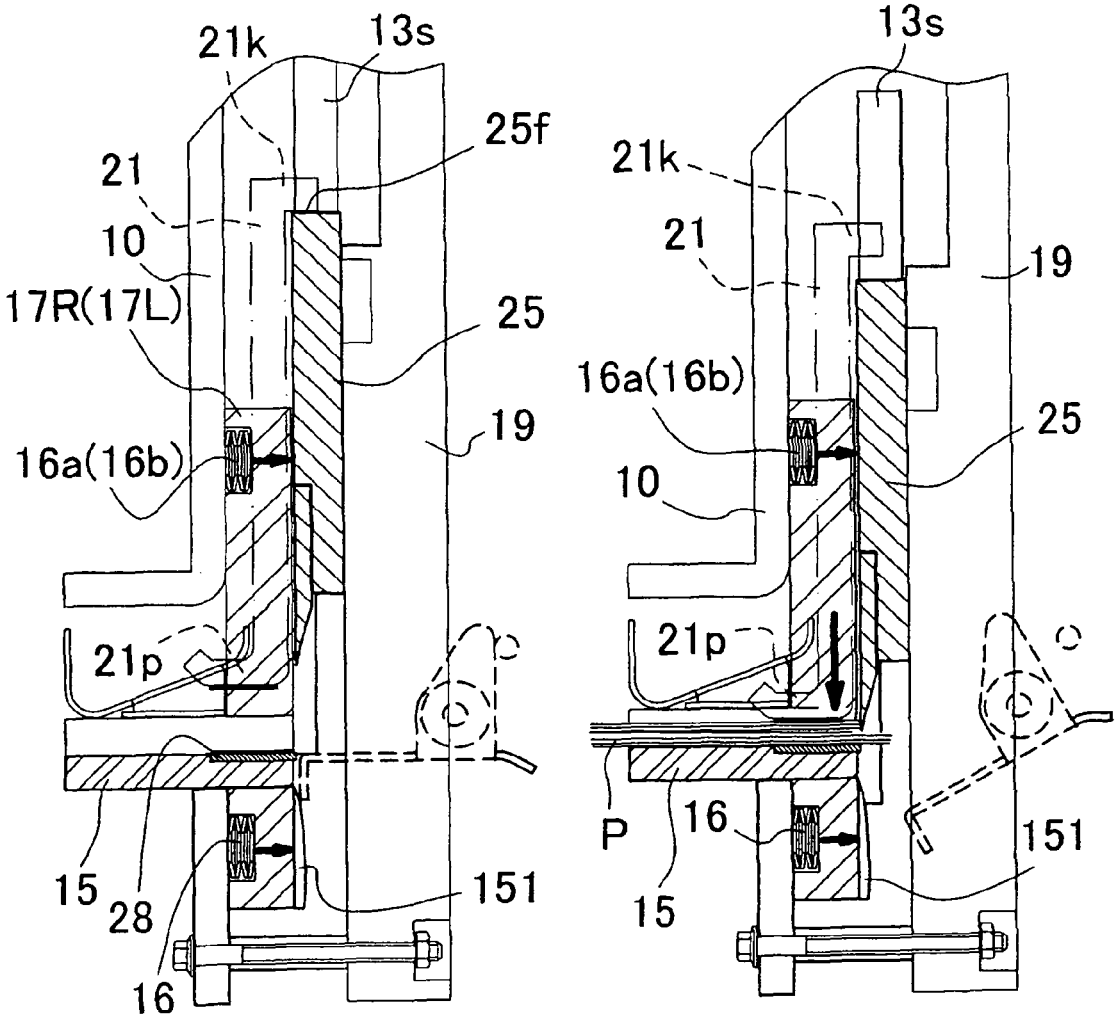
FIGS. 11(*a*) and 11(*b*) are explanatory views of the positioning structure of the stationary cutter edge and the moving cutter edge in the constitution of FIG. 10, wherein FIG. 11(*a*) shows the pressing member waiting at the retreating position, and FIG. 11(*b*) shows the pressing member pressing the sheets on the sheet loading table.
Figure 12:
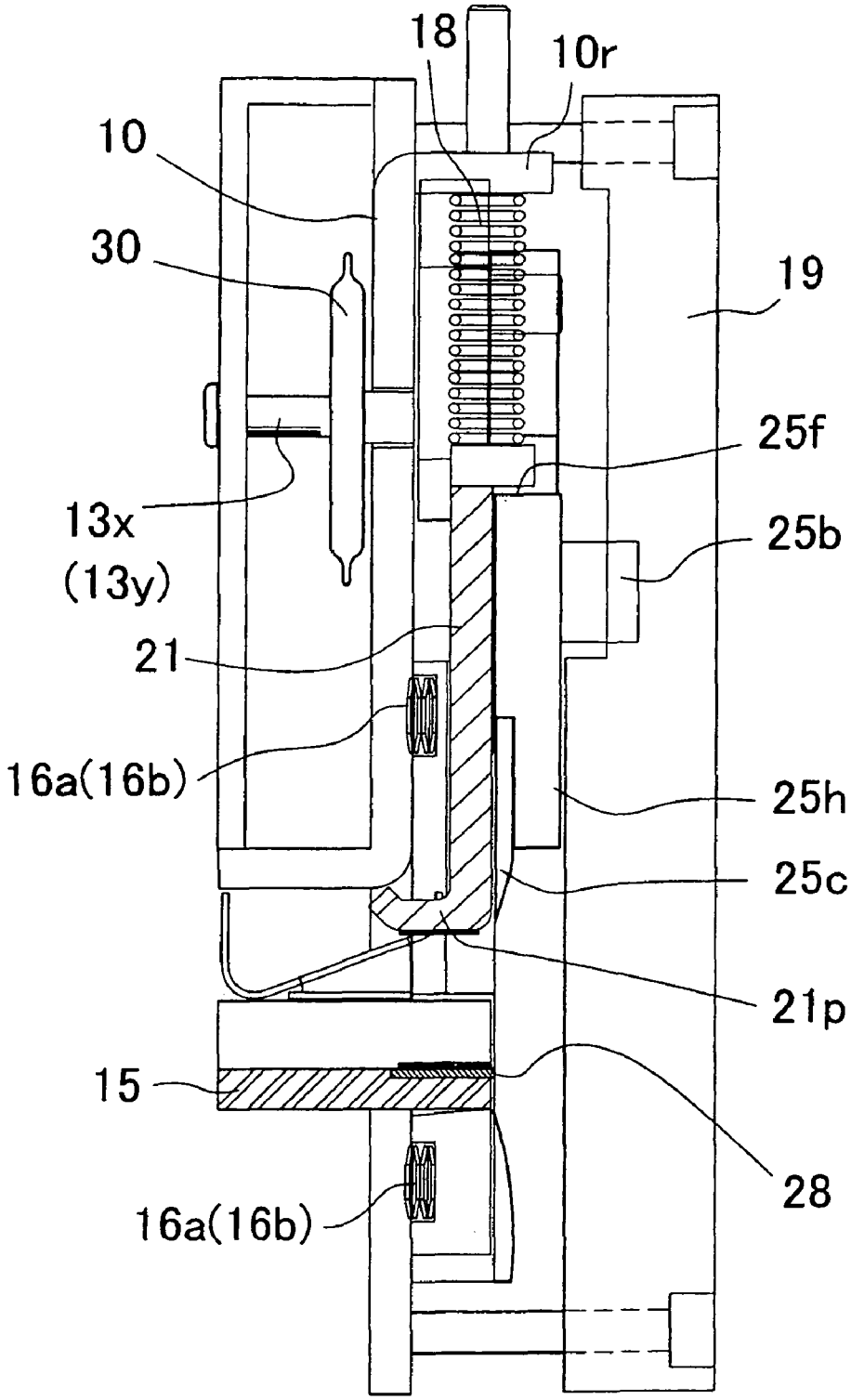
FIG. 12 is an explanatory view for the structure of the cutting edge-pressing means in the apparatus of FIG. 1.

In the above structure, the pressure plate 21 is disposed between the base plate 10 and the moving cutter edge 25. As shown in FIG. 12, the pressure plate 21 in the plane shape is held between the base plate 10 and the moving cutter edge 25, and the pressure plate 21 is disposed at its lower end face (a later mentioned sheet pressing face) 21*p* in the place of urging to support the sheet surface on the sheet loading table. Guide grooves 17*g* formed in the guide members 17R, 17L support the pressure plate 21 vertically moving. The base plate 10 has a bent piece 10*r*, and a pressure spring 18 is fitted to the bent piece 10*r* to press the pressure plate 21 downward in FIG. 11(*b*). Accordingly, the pressure plate 21 disposed between the base plate 10 and the moving cutter edge 25 is composed so that its lower end face (the sheet pressing face) 21*p* presses the sheet surface on the sheet loading table 15.

The lower end face (the sheet pressing face) 21*p* of the pressure plate 21 is, as shown in FIG. 9, bent in L and formed with the sheet pressing face (the lower end face; the same in the following) 21*p* to hold the paper sheet P in relation with the sheet loading table 15. In such a manner, the pressure plate 21 steadily presses and holds the paper sheet with the sheet pressing face 21*p* bent at the lower end part. For this purpose, the sheet pressing face 21*p* is coated with a high frictional paint. The paper sheet is held on the sheet loading table 15 by this frictional paint without causing off-position. The stationary cutter edge 28 equipped as one body to the sheet loading table 15 is also coated with the high frictional paint at a position opposite to the sheet pressing face 21*p* of the pressure plate 21.

Owing to vertical moving of the moving cutter edge 25, the pressure plate 21 vertically moves between a non-operating position (a home position) and the operating position, the non-operating position where the pressure plate 21 retreats from the paper sheet surface above the sheet loading table 15 by vertical movement of the moving cutter edge 25 and the operating position where the pressure plate 21 receives working of the pressure spring 18 and presses the paper sheet surface on the sheet loading table 15. Therefore, the upper end flange part 25*f* of the moving cutter edge 25 and the engaging piece 21*k* of the pressure plate 21 are structured to engage each other. Accordingly, the moving cutter edge 25 and drive rotation members 13 of vertically moving the same compose a pressure releasing means.

Next, following the actuation explanation views shown in FIGS. 11(*a*) and 11(*b*), the relation between the stationary cutter edge 28 and the moving cutter edge 25 will be explained. As later mentioned, the moving cutter edge 25 is supported by a pair of left and right drive rotation members 13*d*, 13*f* and vertically moves with respect to the sheet loading table 15 by rotation thereof. Under a condition of FIG. 11(*a*) that the moving cutter edge 25 waits above the sheet loading table 15, the pressure plate 21 interlocking the moving cutter edge 25 waits at anon-operating position (a waiting position). Under this condition, the paper sheet P is set on the sheet loading table 15. At this time, the stationary cutter edge 28 integrate with the sheet loading table 15 is suppressed to the moving cutter edge 25 by spring force (elastic force) of urging means 16 (16*a*, 16*b*). In short, the guide members 17R, 17L integrate with the stationary cutter edge 28 are suppressed to the cutter edge receiving holder 25*h* of the moving cutter edge 25 by the urging means 16 (16*a*, 16*b*) (compression springs are shown), and the moving cutter edge 25 and the stationary cutter edge 28 are positioned at positions of closely sliding both. The urging means 16 has a large spring constant (for example, 13.5 Kg) of the urging means 16*a* at a cut starting side (a left end) and has a small spring constant (for example, 4.3 Kg) of the urging means 16*b* of a cut ending side (a right end). This is because when an upper cutting edge moves down to the sheet stack, the sheet stack is pressed and bent to exert to bring back an lower cutting edge, and therefore spring force of the urging mans 16*a* of a cut starting side is made large. After then, beginning to cut the sheet stack, the lower cutting edge does not escape in spite of small spring force, and since a preferable cutting actuation is effected, spring force of the urging means 16*b* at the cutting end is set to be small.

Then, after setting the paper sheet P on the sheet loading table 15, when rotating the drive rotation member 13 in a predetermined direction, the moving cutter edge 25 moves down from the upper dead point p1. When the moving cutter edge 25 moves down by the predetermined amount, the pressure plate 21 also moves down toward the paper sheet surface, and the upper end flange 25*f* of the moving cutter edge 25 separates from the engaging piece 21*k* of the pressure plate 21. Then, owing to actuation of the pressure spring 18, the lower end face (a paper pressing face) 21*p* of the pressure plate 21 presses the paper sheet face. This condition is illustrated in FIG. 11(*b*), the pressure plate 21 presses the sheet loading table 15 from the upper side by actuation of the pressure spring 18. Therefore, the stationary cutter edge 28 furnished to the sheet loading table 15 is positioned at the position of sliding with the moving cutter edge 25 by the urging means 16, and held under this condition by the pressure plate 21. When cutting the paper sheet P by means of the moving cutter edge 25, the stationary cutter edge 28 does not escape even if force acts in an arrow direction by shearing force. It is thereby possible to lower urging force of the pressure spring urging the stationary cutting edge in the side of the cutter edge and reduce the apparatus in scale.

In the pressure spring 18 acting on the pressure plate 21 and the spring force of the urging means 16 acting on the stationary cutter edge 28, the force at the side of the pressure spring is set to be larger. In short, when the stationary cutter edge 28 is at the non-operating position, it moves to a position contacting the moving cutter edge 25 by the spring force (elastic force) of the urging means 16, but when the pressure plate 21 is at the operating position, it is held there by the action of the pressure spring 18, and the spring force is set not to move the pressure plate 21.

[Structure of the Moving Cutter Edge]

The moving cutter edge 25 is, as shown in FIG. 1, composed of the plane-shaped edge of the blade 25*c* and the cutter edge receipt holder 25*h*. The cutter edge receipt holder 25*h* is composed of a member having mechanical strength durable against resistance caused by cutting the sheet stack, and its lower end is formed with a concave groove 25*w* for attaching the edge of the blade. 25*b* designates a reinforcing stay which is fixed integrally with the cutter edge receipt holder 25*h* along the cutting-plane line CL. In the concave groove 25*w*, the edge of the blade 25*c* is attached by an adhesive tape. The edge of the blade 25*c* is inclined at a suited angle in the direction of cutting-plane line CL in order to gradually cut the sheet stack P from one end to the other. In the illustrated edge of the blade 25*c*, an angle α illustrated in FIG. 7(*b*) is inclined in a range of from 3° to 15°.

[Drive Mechanism of the Moving Cutter Edge]

The vertically moving mechanism of the above mentioned moving cutter edge 25 will be explained, referring to FIGS. 2, 3 and 4. As mentioned above, the pair of drive rotation members 13*d*, 13*f* are arranged at the position with a distance along the cutting-plane line CL at the base plate 10. With respect to drive rotation members 13, as shown in FIG. 4, a pair of rotation shafts 13*x*, 13*y* are supported with bearings to the base plate 10 at the position with a distance along the cutting-plane line CL. To the pair of left and right rotation axes 13*x*, 13*y*, the drive rotation members 13*d*, 13*f* such as an arm member and an eccentric cam are secured. To the drive rotation members 13, transmission pins 13*p* (cam followers are also sufficient) are provided at positions different from those of the rotation shafts 13*x*, 13*y*, and the moving cutter edge 25 is pivoted to the transmission pins 13*p*. Accordingly, if rotating the pair of left and right drive rotation members 13*d*, 13*f* around the rotation shafts 13*x*, 13*y*, the moving cutter edge 25 move vertically as drawing an arc along the base plate 10.

The rotation shafts 13*x*, 13*y* of the respective drive rotation members 13*d*, 13*f* are, as shown in FIG. 3, connected to a drive motor M. At the backside of the base plate 10, sprockets 30 are provided integrally with the rotation shafts 13*x*, 13*y*, and the left and right sprockets 30*a*, 30*b* are bridged with a transmission chain 29. The drive motor M is connected to the sprocket 30*a* of the drive rotation member 13*d* positioning at the driving side via a reduction gear 31.

Figure 5A:
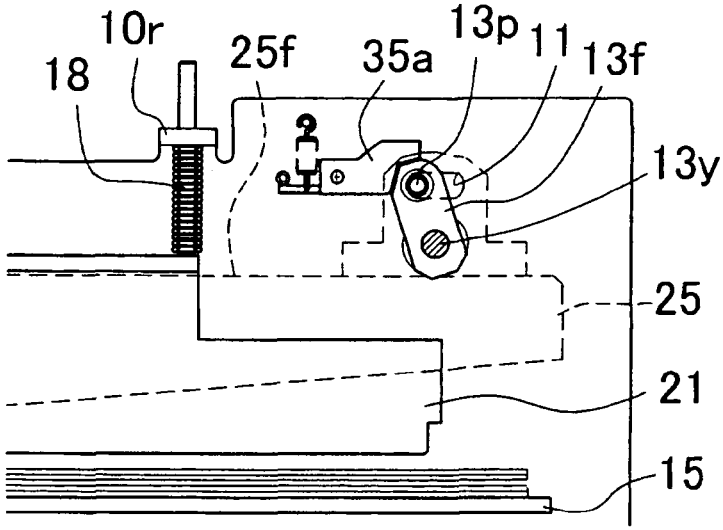
FIGS. 5(*a*) to 5(*c*) are explanatory views of the working conditions of the pressing means and the moving cutter edge, wherein FIG. 5(*a*) shows that the pressing means is at a waiting position, FIG. 5(*b*) shows that the pressing means is at an upper dead point, and FIG. 5(*c*) shows that the pressing means performs the pressing.
Figure 5B:
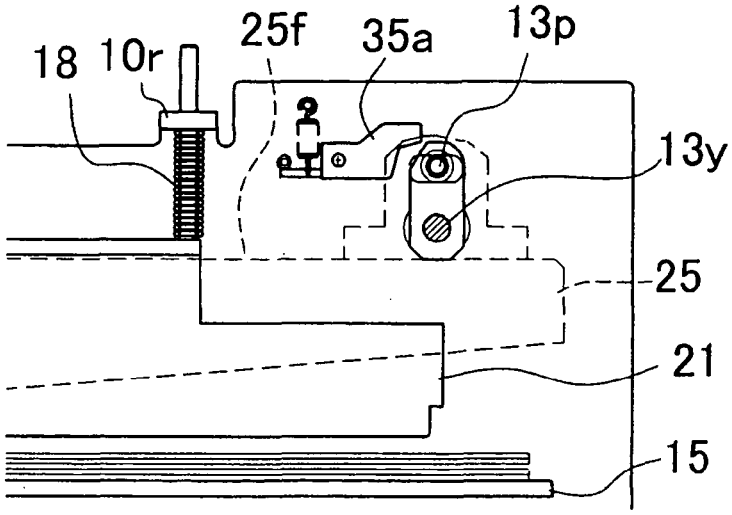
Figure 5C:
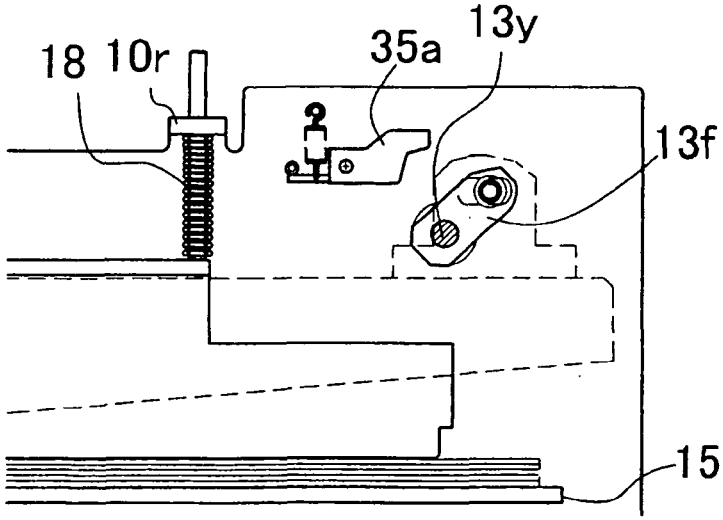
Figure 7A:
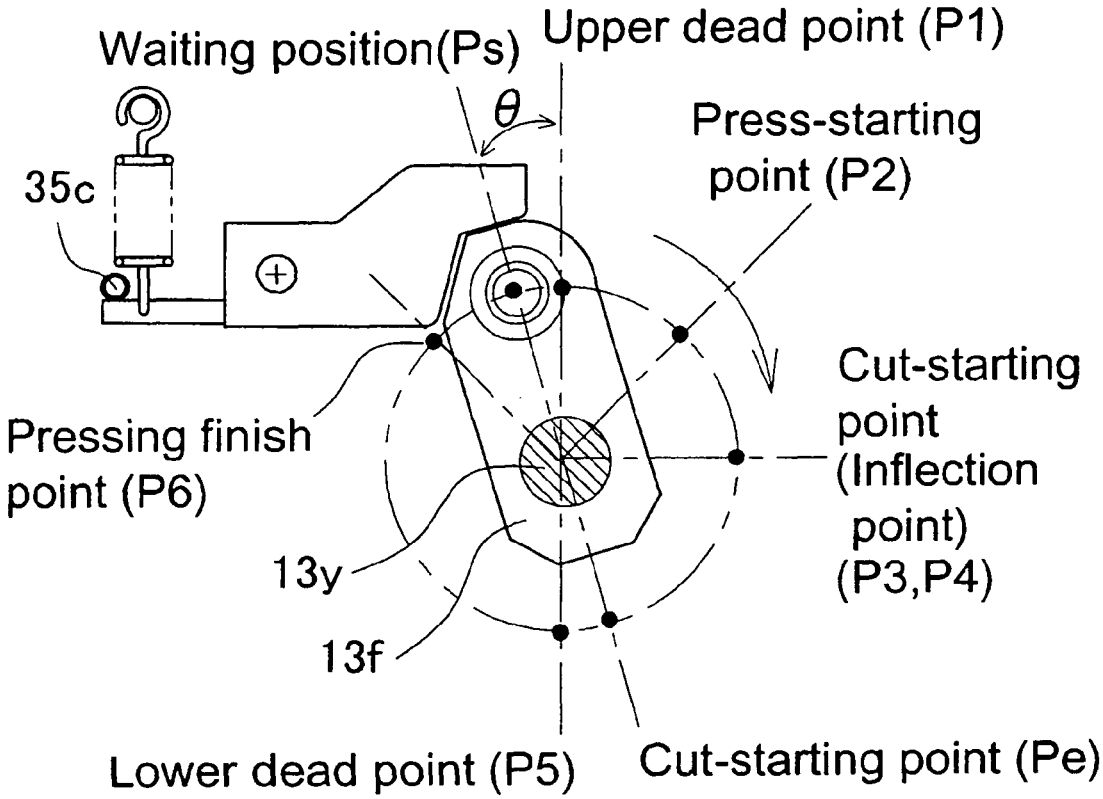
FIGS. 7(*a*) and 7(*b*) are explanatory views of the working conditions of the drive rotation member in the apparatus of FIG. 1, wherein FIG. 7(*a*) is an explanatory view of moving locus, and FIG. 7(*b*) shows the cutter edge is at the waiting position (upper dead point)
Figure 7B:
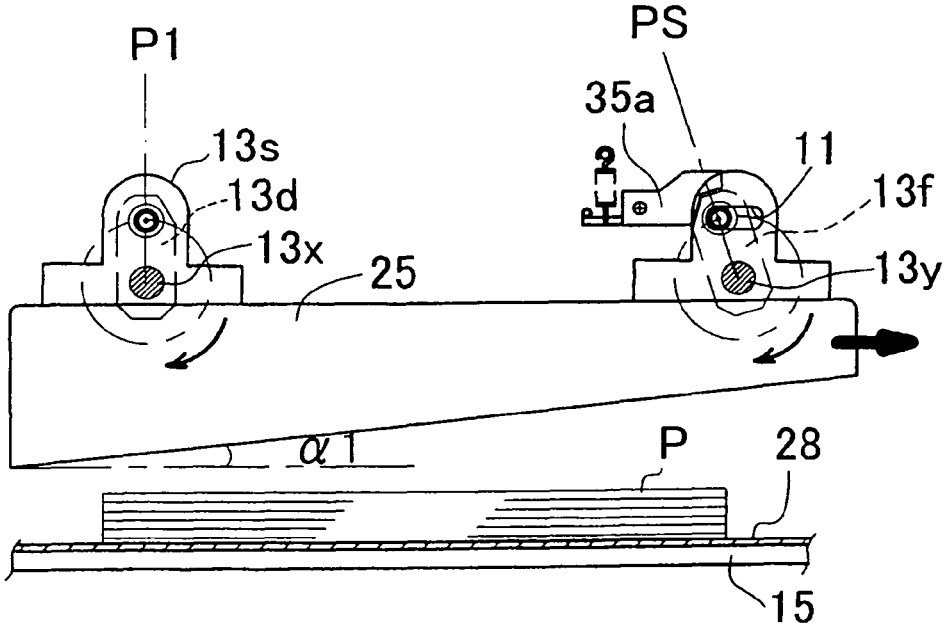

Next, explanation will be made to the connecting relation between the drive rotation members 13*d*, 13*f* and the moving cutter edge 25 as shown in FIGS. 7(*a*) and 7(*b*). As mentioned above, the pair of left and right drive rotation members 13*d*, 13*f* are synchronized by rotation of the drive motor M and rotate at the same angular velocity. As shown in FIG. 7(*a*), the pair of left and right drive rotation members 13*d*, 13*f* rotate clockwise from the home position (the waiting position) PS in order of the upper dead point P1, press starting point P2, cut starting point P3, inflection point P4, cut finishing point Pe and press finishing point P6. In short, the pressure plate 21 and the moving cutter edge 25 wait at the position where they retreat above the sheet loading table 15, and this position is determined at the home position PS. Under the condition where both wait at the home position, the sheet stack is sent to set on the sheet loading table 15 or the sheet stack after having been cut are delivered therefrom (this condition is shown in FIG. 5(*a*)). When the drive rotation member 13 passes the upper dead point P1 and rotates clockwise, the pressure plate 21 and the moving cutter edge 25 gradually move down toward the sheet stack on the sheet loading table 15 by interlocking the clockwise rotation. Then, the sheet pressing face 21*p* of the pressure plate 21 presses the sheet surface at the press starting point P2. FIG. 5(*b*) shows the condition where the drive rotation member 13 passes the upper dead point P1, and FIG. 5(*c*) shows the condition where the pressure plate 21 presses the sheet surface of the sheet stack.

Figure 6:
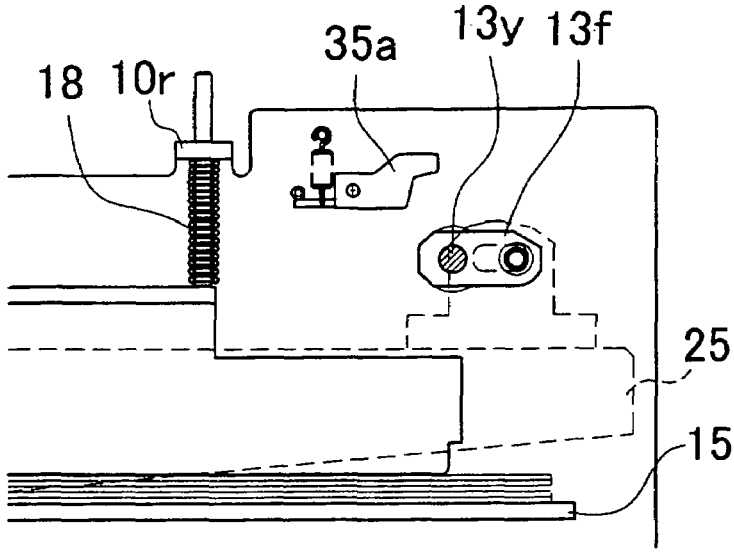
FIGS. 6(*a*) to 6(*c*) are explanatory views of the working conditions of the pressing means and the moving cutter edge, wherein FIG. 6(*a*) shows a cut-starting point, FIG. 6(*b*) shows a cut-ending point, and FIG. 6(*c*) shows a press-releasing point.
Figure 6:
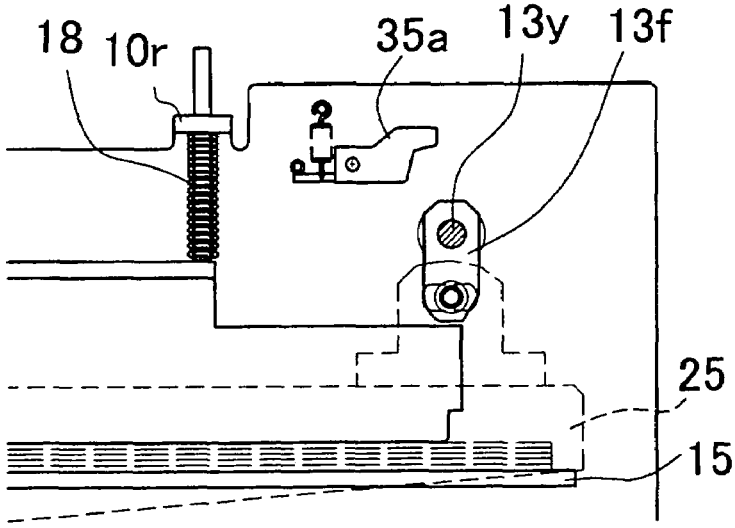
Figure 6:
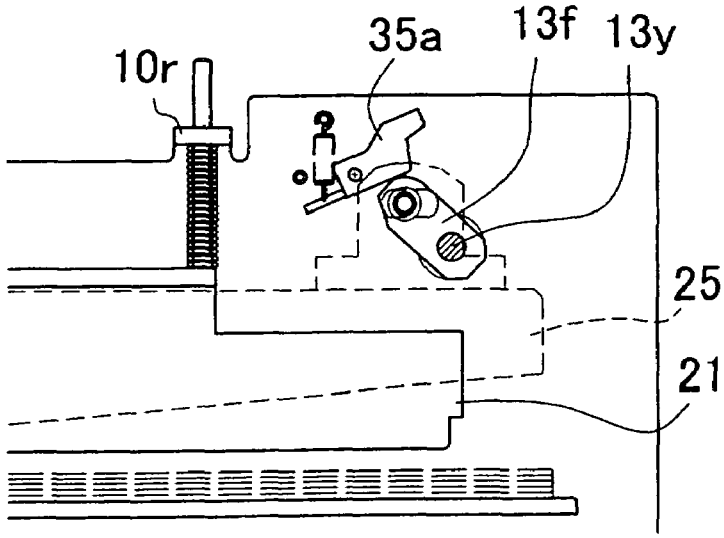

Subsequently, when the drive rotation member 13 further rotates and reaches the inflection point P4, the pressure plate 21 steadily presses the paper sheet face owing to the action of the pressure spring 18, and reaches the cut starting point P3 before and after of the inflection point P4 (the rotational angle almost meeting the inflection point P4 is shown). Since the moving cutter edge 25 inclines the edge of the blade at an inclination angle α, it cuts the sheet stack on the sheet loading table 15 from one end to the other. The cut starting condition is shown in FIG. 6(*a*). Then, the pressure plate 21 separates from the moving cutter edge 25 and remains at the position of pressing the paper sheet face. When the drive rotation member 13 reaches a cut finishing point Pe before the lower dead point P5, the moving cutter edge 25 completely cuts the sheet stack on the sheet loading table 15 and finishes the cutting (this condition is shown in FIG. 6(*b*)). When the drive rotation member 13 passes the lower dead point P5 and reaches nearly the front end of the waiting position (the home position) PS, the pressure plate 21 separates from the paper sheet face on the sheet loading table 15 by interlocking with rising of the moving cutter edge 25, and the pressing force is released (this condition is shown in FIG. 6(*c*)).

The illustrated apparatus interlocks a rotation axis 13$x$ at the drive side connected to the drive motor M with a rotation axis 13$y$ at the following side connected to the rotation axis 13$x$ with the transmission chain 29 in order to form a phase difference θ each other. In short, with respect to the drive rotation member 13$d$ of the rotation axis 13$x$ at the driving side, the drive rotation member 13$f$ of the rotation axis 13$y$ at the following side is delayed by the angle θ shown in FIG. 7($a$). By this phase difference θ, with respect to the inclination angle α (the shearing angle) between the moving cutter edge 25 and the paper sheet face, comparing the angle α1 under the waiting condition of FIG. 7($b$) with the angle α2 under the shear starting condition of FIG. 8($a$), the latter angle is larger (α1<α2). Accordingly, it is possible to enlarge the shearing angle of cutting the paper sheet without enlarging the vertical stroke of the moving cutter edge 25 (not enlarging the scale of the apparatus). In company with progressing of cutting the paper sheet, comparing the angle α3 on the way of cutting of FIG. 8($b$) with the angle α4 at cut-finishing, both are nearly equal when cut-staring angle α1 (α1≅α3≅α4).

As mentioned above, the rotation axis 13$x$ at the drive side and the rotation axis 13$y$ at the following side rotate at the same peripheral velocity, and the phase difference (the angle θ) is formed between the drive rotation member 13$d$ at the drive side and the drive rotation member 13$f$ at the following side. By this relation, at least one of the drive side and the following side must be idly connected in the direction crossing with the vertically cutting direction to the moving cutter edge 25 and the drive rotation member 13 (without idleness, the two drive rotation members buffer each other, and the motion is locked). Therefore, in the illustration, the drive rotation member 13$f$ at the following side and the moving cutter edge 25 are fittingly mounted idly in an oblong hole 11 (refer to FIG. 2).

When the moving cutter edge 25 moves down from the upper part to the lower part to cut the paper sheet P, the moving cutter edge 25 performs the cutting as moving in the cutting-plane line CL direction. The moving cutter edge 25 turns reversely the moving direction when cut-starting and cut-finishing. In short, the moving cutter edge 25 waits at the shown P1 where the drive rotation member 13$d$ at the drive side positions at the upper dead point as shown in FIG. 7($b$), and the pressure plate 21 presses the paper sheet face at the shown P2 of rotating clockwise at a specific angle, and at the shown P3, the cutting starts, and at the shown P5 (the lower dead point), the cutting ends.

Therefore, the moving cutter edge 25 whirling around the rotation axes 13$x$, 13$y$ start to cut the paper sheet between the upper dead point of the arc locus and the inflection point P4, and the cutting is finished at the lower dead point P5 exceeding the inflection point P4. Since the cut-starting point of the permitted maximum paper sheet is set between the upper dead point P1 and the inflection point P4, when the moving cutter edge 25 moves down from the waiting position to the cutting position, at first, to the right side (FIG. 8($a$), the arrow A) in the cutting-plane line CL direction, and subsequently (after exceeding the inflection point P4) moves to the left side (FIG. 8($c$), the arrow B). Thereby, when starting the cutting, the edge of the blade of the moving cutter edge 25 moves down as moving to the right side of the paper sheet on the sheet loading table 15, and after going over the inflection point P4, the edge of the blade moves down as moving to the left side to cut the paper sheet.

When cut-starting, since the moving cutter edge 25 goes into the paper sheet as moving to the front side (the right side in FIG. 4) and even if the paper sheet is weak, the cutting depth can be secured. When cut-finishing, since the moving cutter edge 25 finishes to cut as moving to the left side of FIG. 4, the cutting plane does not go out of order. As to cutting of the paper sheet P by the moving cutter edge 25, when cutting, for example, soft and weak materials with a flat-blade knife, if cutting the material as pushing forward the edge of the blade, the cutting is easy in the depth direction, and reversely, when cut-finishing, if cutting the material as pulling backward the edge of the blade, the cutting plane is regulated. If determining the cutting direction of the moving cutter edge 25 from the left side to the right side, force in the right direction is loaded to the paper sheet P, the paper sheet P is pulled in the right direction and the right end is torn off. But if determining the rotating direction of the moving cutter edge 25 from the right side to the left side (clockwise), since force acts in the left direction, the moving cutter edge 25 pushes the paper sheet to the left side even at cut-finishing, and the cut face is regulated.

[Position Holding Mechanism of the Pressure Member]

With respect to the drive rotation members 13$d$, 13$f$, based on FIG. 7($a$), the waiting position (the home position) PS is, as mentioned above, set at a position displaced at a fixed angle (θ) before the upper dead point P1. This is because the urging force of the pressure spring 18 acting on the pressure plate 21 is made actuate in a reverse rotation direction to the drive rotating direction (clockwise). Thereby, the pair of left and right drive rotation members 13$d$, 13$f$ receive actuation of the pressure spring 18 in the reverse rotating direction to the drive rotating direction under the condition where the drive motor M stops at the waiting position PS. Accordingly, the drive rotation member 13 rotates in the shown counterclockwise direction by the urging force of the pressure spring 18 at the waiting position PS, and the moving cutter edge 25 and the pressure plate 21 might move down. Therefore, the illustrate apparatus has a lock means (movement restraining means; the same in the following) to one of the drive rotation members 13$d$ (the drive side) and (the following side).

The movement restraining means 35 is composed of (1) a rotation stopping pawl disposed to the drive rotation member 13$f$, or (2) a uni-directional rotating clutch disposed to the rotation axis 13$y$ of the drive rotation member 13$f$, or (3) a braking member (brake shoe) disposed to the drive rotation member 13$f$. The movement restraining means 35 shown in FIGS. 4 to 6($c$) is composed of a lock means disposed to the drive rotation member 13$f$ of the following side. The lock means 35 is composed of the rotation stopping pawl 35$a$ prohibiting a counterclockwise rotation (reversal rotation) in FIG. 4 so that drive rotation member 13 is not moved downward from the waiting position PS. The rotation stopping pawl 35$a$ is positionally restrained to a stopper 35$c$ by a return spring 35$b$ so that the drive rotation member 13$f$ is allowed to rotate in the clockwise direction (the drive rotating direction) but is prohibited to rotate in the counterclockwise direction (the anti-drive rotating direction). Thereby, the moving cutter edge 25 and the pressure plate 21 positioning in the waiting position PS are prohibited to move down in the cutting direction by the urging force of the pressure spring 18.

As the movement restraining means, it is sufficient to build the uni-directional rotating clutch allowing rotation in the drive direction in the rotation axis 13$y$ of the drive rotation member 13$f$, and similarly, the brake shoe may be slid to the drive rotation member 13$f$.

Explanation will be made to actuation of the moving cutter edge 25 structured as mentioned above, referring to FIGS. 7($a$) to 8($c$). FIG. 7($b$) shows the condition (the cut-waiting condition) where the moving cutter edge 25 retreats to the upper waiting position. At this time, the drive rotation member 13$d$ positioning to the drive side positions at the upper dead point P1, and the moving cutter edge 25 and the pressure plate 21 retreat upward from the paper sheet surface on the sheet loading table 15. Under this waiting condition, the paper sheet is set for sending on the sheet loading table 15. Subsequently, when the drive motor M starts to rotate clockwise the drive rotation members 13*d*, 13*f*, the moving cutter edge 25 slowly moves down from the upper dead point P1 and the pressure plate 21 also moves down in conjunction therewith. When the drive rotation member 13*d* comes to the shown P2 point, the pressure plate 21 presses, at the lower end face (the sheet pressing face) 21*p*, the paper sheet surface. When the drive rotation members 13*d*, 13*f* move to the shown P3, the moving cutter edge 25 starts to cut the paper sheet surface.

Figure 8A:
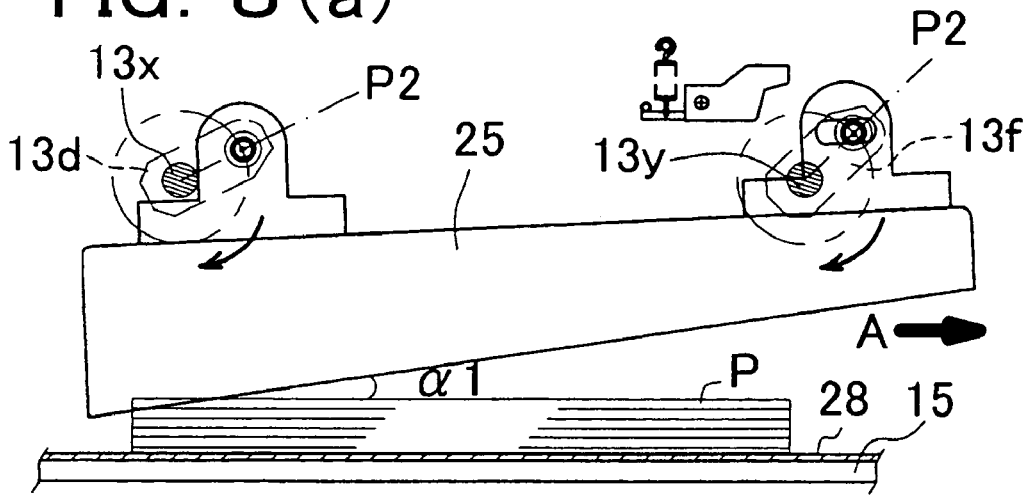
FIGS. 8(*a*) to 8(*c*) are explanatory views of cutting the sheet stack in the apparatus of FIG. 1, wherein FIG. 8(*a*) shows an initial condition of cutting the sheet stack, FIG. 8(*b*) shows a middle condition thereof, and FIG. 8(*c*) shows a finish of the same.
Figure 8B:
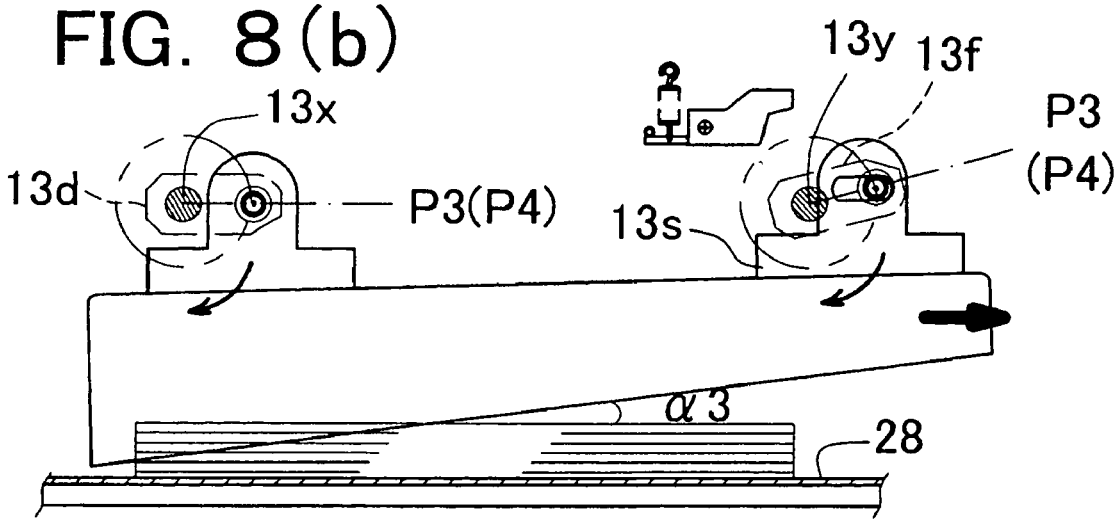
Figure 8C:
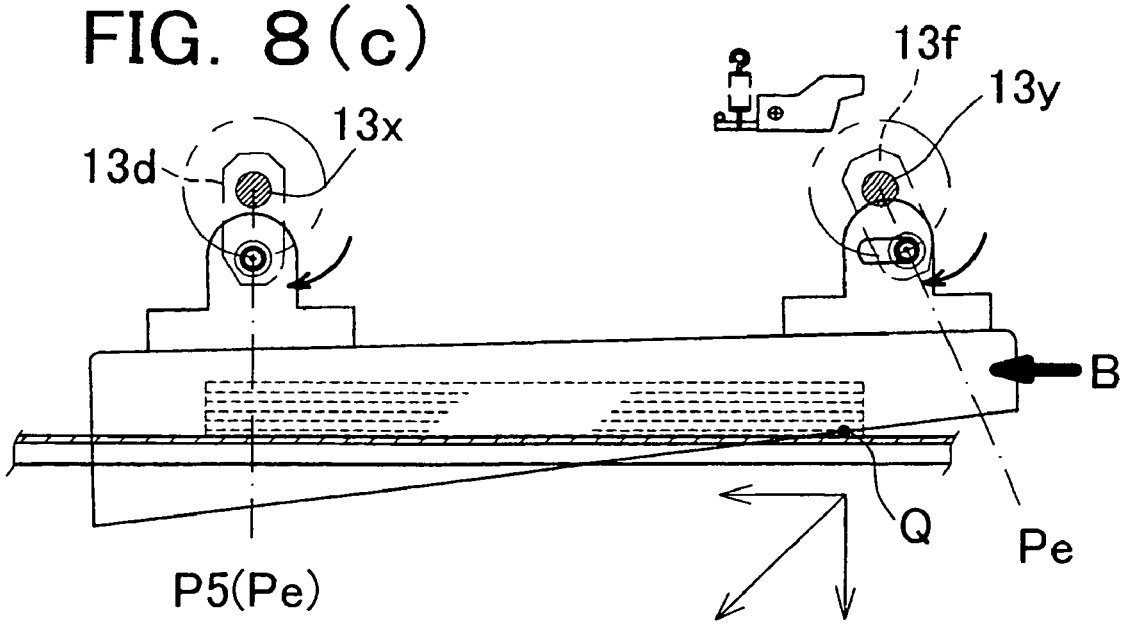

While the drive rotation members 13*d*, 13*f* move from the P3 point to the P4 point of FIG. 8(*a*), the moving cutter edge 25 moves down as moving to the right side of the same, and the edge of the blade goes into the interior of the paper sheet as pushing it. When the drive rotation members 13*d*, 13*f* exceed the P4 point (the inflection point) of FIG. 8(*b*), the moving cutter edge 25 deeply enters into the interior of the paper sheet as moving to the left side. When the moving cutter edge 25 reaches the lower dead point P5 (the condition of FIG. 8(*c*)), the cutting of the paper sheet is finished.

[Exchanging Structure of the Moving Cutter Edge]

The above structured moving cutter edge 25 is supported (mount) on the base plate (the apparatus frame) 10 via the drive rotation members 13*d*, 13*f*. Then, the drive motor M is placed to face the apparatus front side. The moving cutter edge 25 is placed so that the edge of the blade is inclined to the paper sheet face on the sheet loading table 15, and this inclination is formed so that the apparatus front side is lowered and the rear side becomes gradually higher. This is because when exchanging the moving cutter edge 25, it is drawn out to the front side. Since the cutter edge is formed to be wider in width at the front side and narrower in width at the rear side, exchanging is easy and safe.

[Exchanging Structure of the Moving Cutter Edge]

The moving cutter edge 25 is placed to be inclined at the fixed angle ($\alpha$>0 degree) in the vertically cutting direction (the z direction in FIG. 1) so that it gradually cuts the paper sheet P on the sheet loading table 15 from one end to the other. The moving cutter edge 25 and the stationary cutter edge 28 are placed so that one inclines at the fixed angle ($\beta$) to the other in the cutting-plane line direction. The moving cutter edge 25 shown in FIGS. 13(*a*) to 13(*d*) is placed to be inclined at the fixed angle ($\beta$>0 degree) to the stationary cutter edge 28 placed to meet the cutting-plane line CL. At the same time, the moving cutter edge or the stationary cutter edge are structured to be positionally movable in the sheet surface direction crossing with the cutting-plane line CL.

At least one of the moving cutter edge 25 and the stationary cutter edge 28 is structured to incline with respect to the cutting-plane line CL at the fixed angle ($\beta$), and one of the moving cutter edge 25 and the stationary cutter edge 28 is structured to be positionally movable in the sheet surface direction of the paper sheet to be cut. Thereby, when gradually cutting the paper sheet P from one end to the other by the moving cutter edge 25, the moving cutter edge 25 steadily slides (contacts) with the edge of the blade of the stationary cutter edge 28 at the cutting point op (see FIG. 13(*a*)).

Explanation will be made to the relation between the moving cutter edge 25 and the stationary cutter edge 28 when gradually cutting the paper sheet P from one end to the other. When gradually cutting the paper sheet P from the cutting point po1 toward po2, the paper sheet P is cut by the cutting length Lx1. At this time, the stationary cutter edge 28 is moved by the distance Ly1 in the sheet surface direction. This distance Ly1 is calculated by the expression 1 (Ly1=Lx1×tan $\beta$) and the expression 2 (Ly2=Lx2×tan $\beta$). In short, when gradually cutting the paper sheet P from the cutting point po1 toward po2, the stationary cutter edge 28 is moved by the amounts of Ly1 or Ly 2 shown in FIG. 13(*a*), and the moving amounts are calculated by the expressions 1 and 2. Then, the paper sheet P on the sheet loading table 15 is cut linearly along the cutting-plane line CL.

Figure 13A:
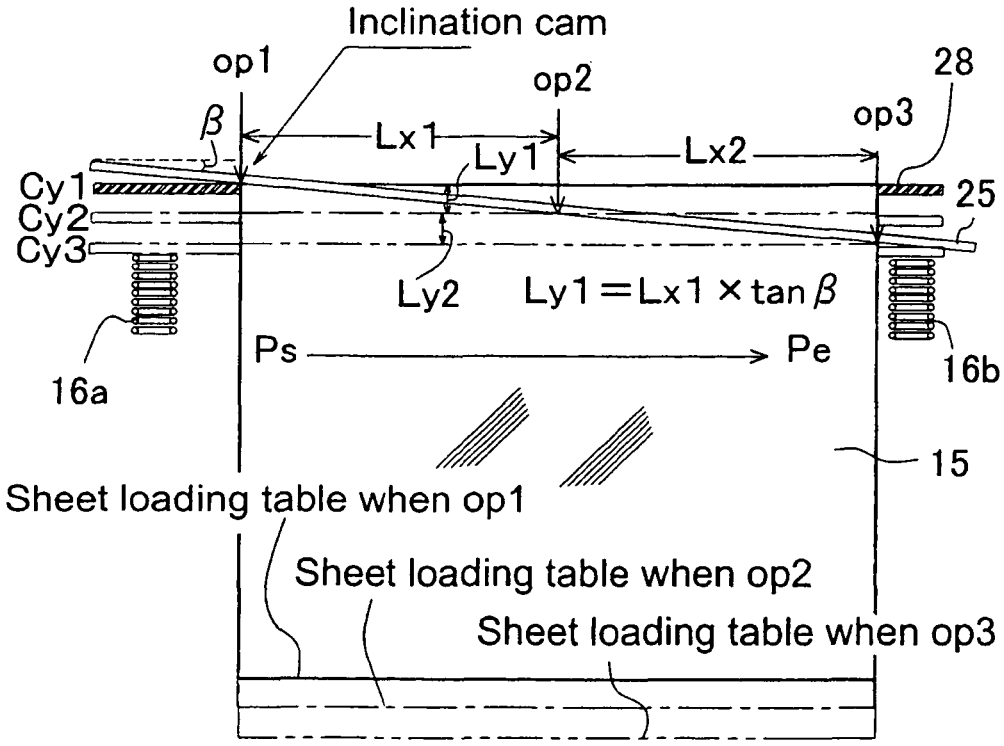
FIGS. 13(*a*) to 13(*d*) show the structure of the sheet loading table unit in the apparatus of FIG. 1, wherein FIG. 13(*a*) is an explanatory view showing the movement of the sheet loading table when slowly cutting the sheet stack from one end to the other end, FIG. 13(*b*) shows a shifting condition of the sheet loading table at the cutting point OP1, FIG. 13(*c*) shows a shifting condition of the sheet loading table at the cutting point OP2, and FIG. 13(*d*) shows a shifting condition of the sheet loading table at the cutting point OP3.
Figures 13B, 13C, 13D:
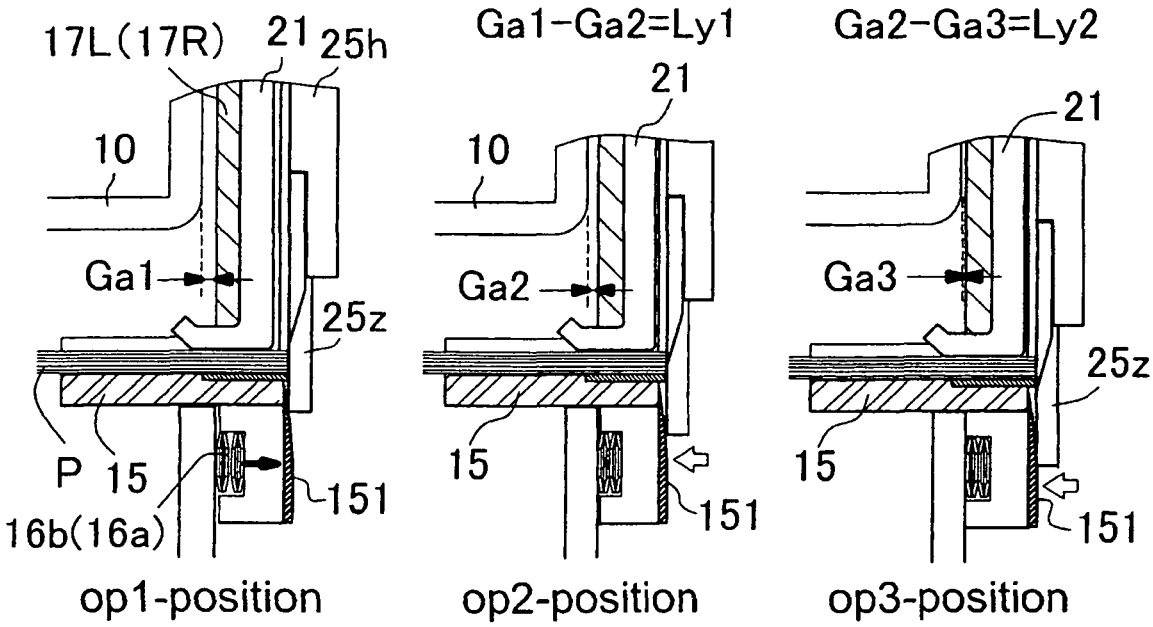

FIGS. 13(*a*) to 13(*d*) show the case that the stationary cutter edge 28 is positionally moved in the sheet surface in company with moving of the cutting point po. It is also sufficient to positionally move the moving cutter edge 25 in the sheet surface, and in such a case, the moving cutter edge 25 moves in the opposite direction to the shown one.

Figure 14B:
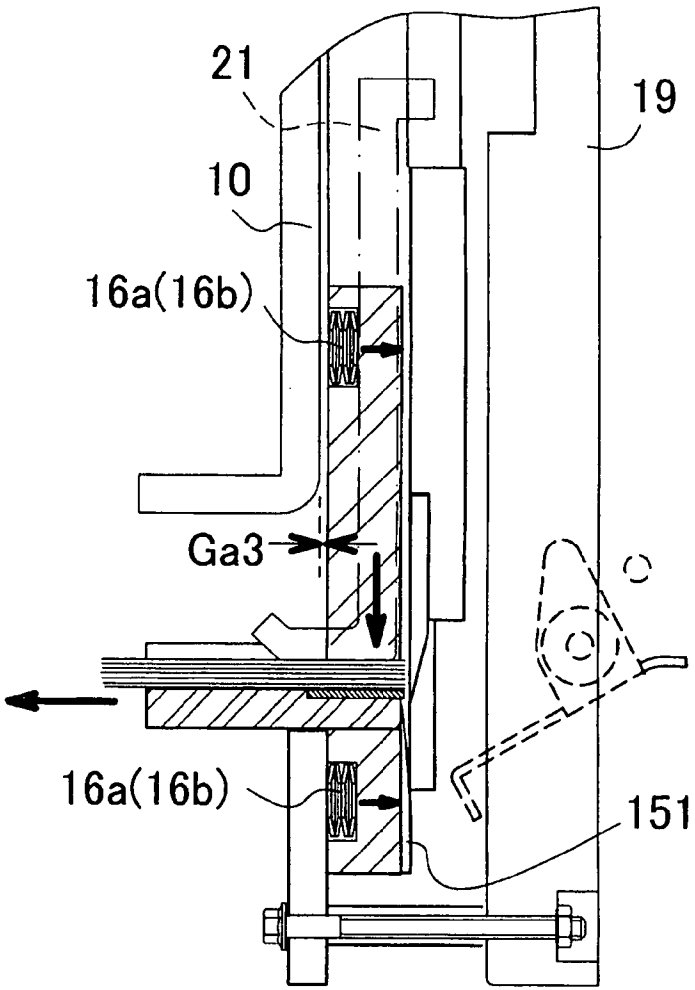
FIGS. 14(*a*) and 14(*b*) are explanatory views showing the structure of the sheet loading table unit in the apparatus of FIG. 13, wherein FIG. 14(*a*) shows the cross sectional condition at beginning of cutting, and FIG. 14(*b*) shows the cross sectional condition at finishing of cutting.
Figure 14A:
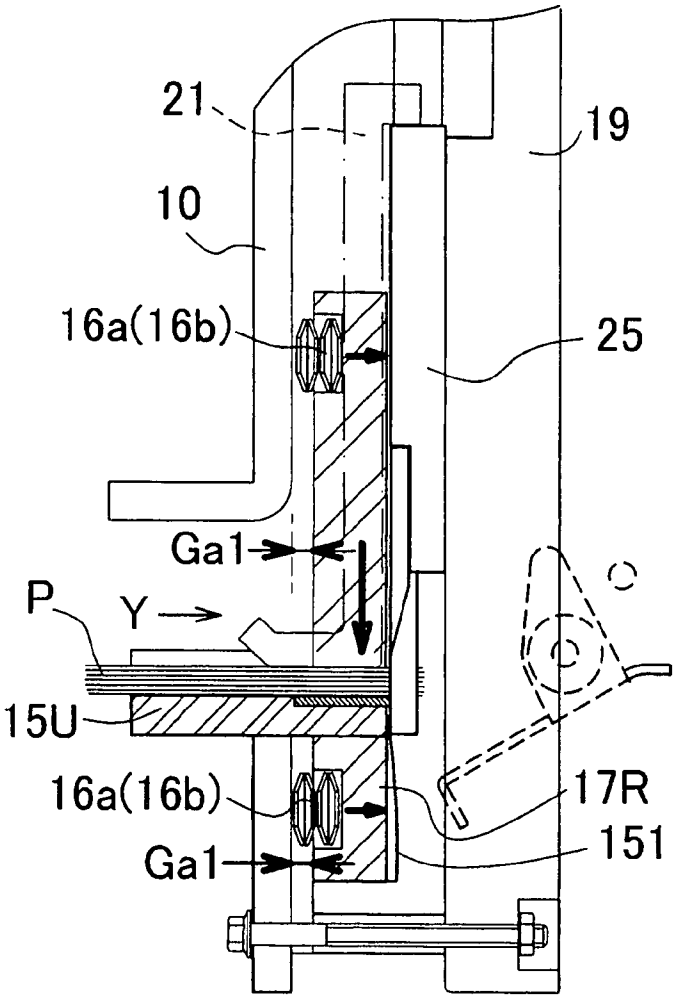

Next, explanation will be made to the structure of positionally moving the moving cutter edge 25 or the stationary cutter edge 28 in the sheet surface of the paper sheet P. FIGS. 14(*a*) and 14(*b*) show cases of moving the stationary cutter edge 28. As mentioned above in FIGS. 8(*a*) to 9, the stationary cutter edge 28 is attached integrally to the sheet loading table 15 (generally called both members as "sheet loading table unit 15U" hereafter). The sheet loading table unit 15U is movably attached to the base plate (the apparatus frame) in the sheet surface direction (in the Y direction shown in FIG. 1) of the paper sheet to be cut. Between the base plate 10 and the sheet loading table unit 15U, there is provided the urging means (the compression spring) 16 (16*a*, 16*b*) for urging the sheet loading table unit 15U in order to urge the stationary cutter edge 28 to slide with the moving cutter edge 25.

Figure 15:
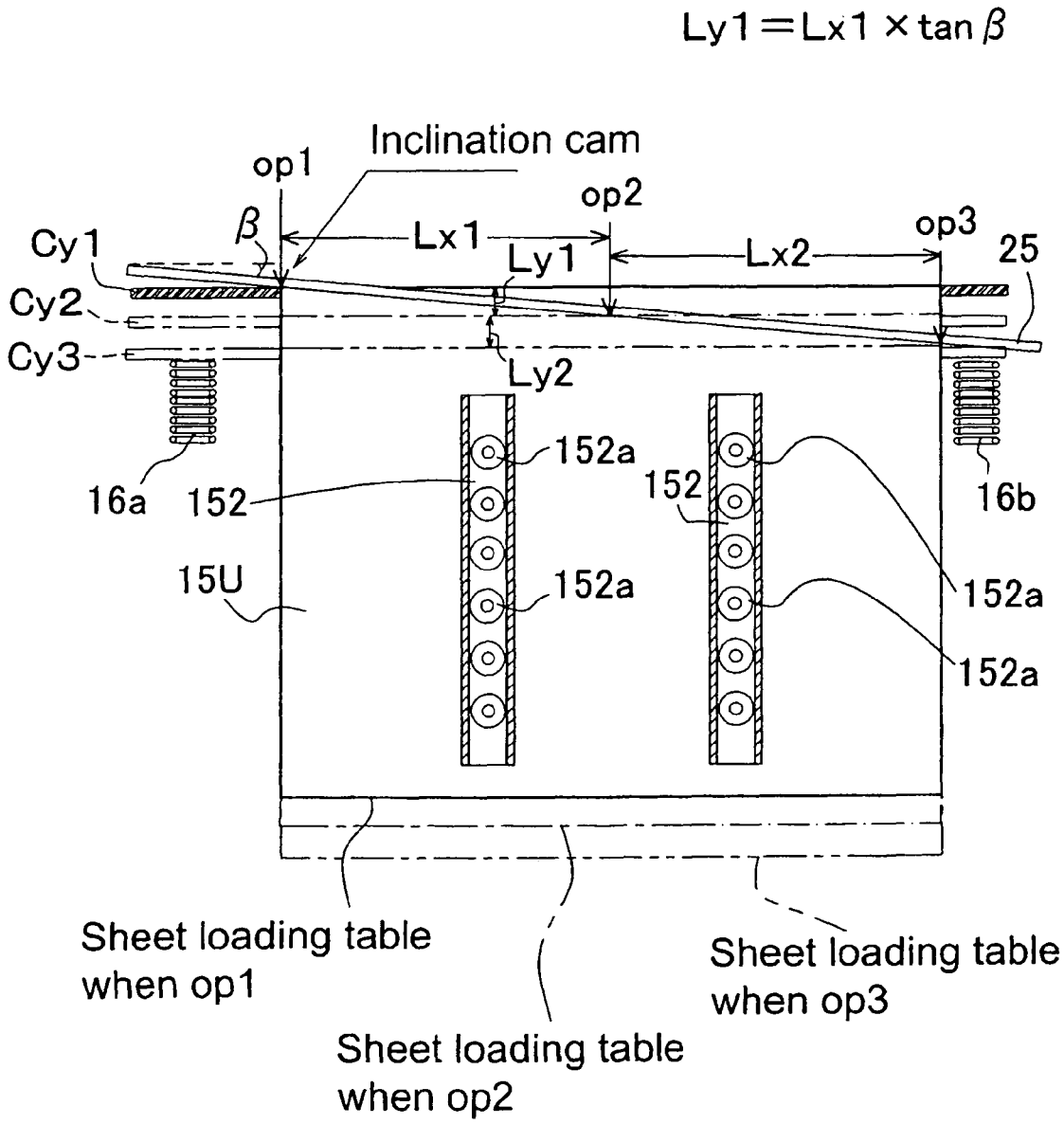
FIG. 15 is an explanatory view showing an embodiment different from that of FIGS. 13(*a*) to 13(*d*) concerning the sheet loading table unit in the apparatus of FIG. 1.
Figure 16A:
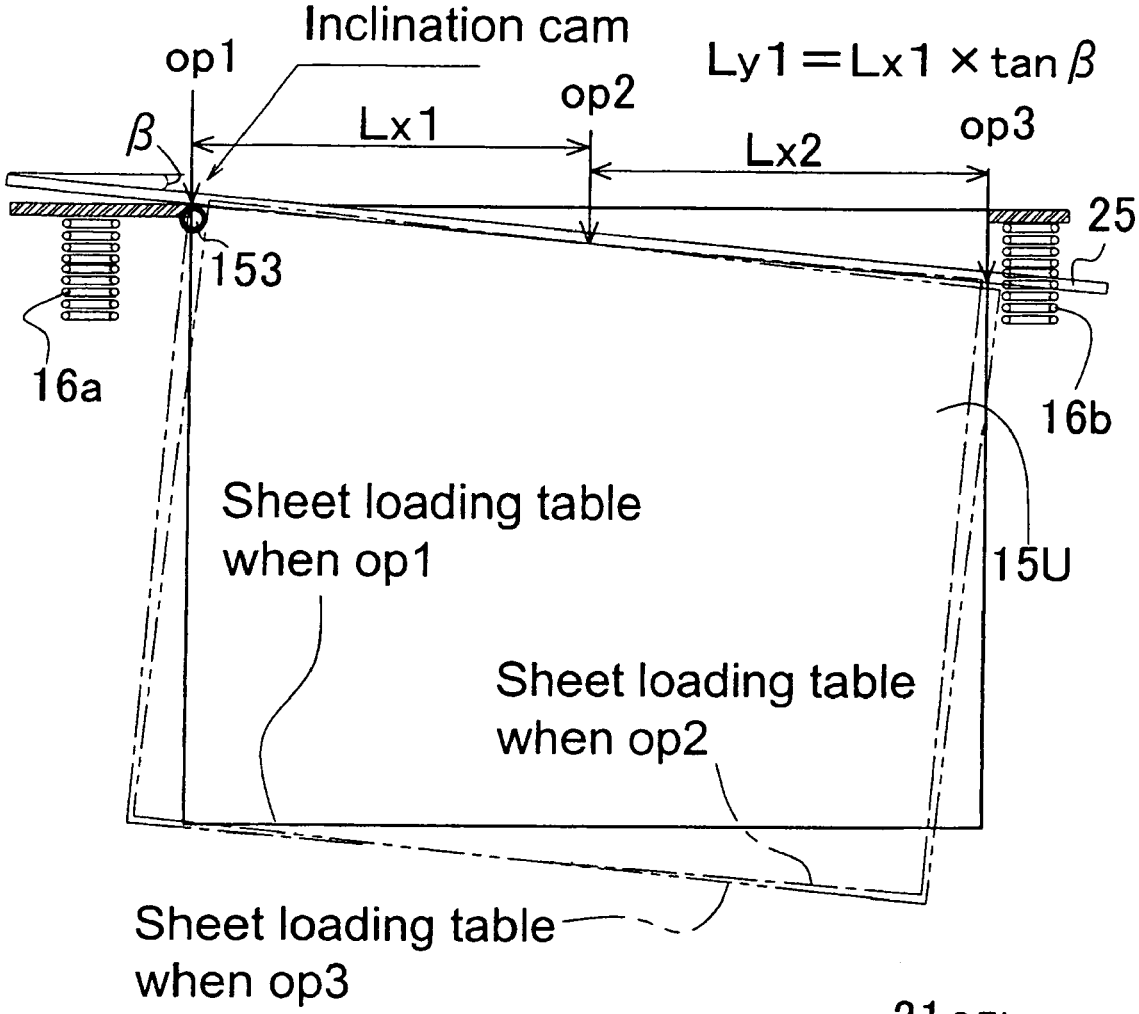
FIGS. 16(*a*) and 16(*b*) are explanatory views showing an embodiment different from those of FIGS. 13(*a*) to 13(*d*) and 14(*a*) and 14(*b*) concerning the sheet loading table in the apparatus of FIG. 1, wherein FIG. 16(*a*) shows the plan structure of the sheet loading table unit, and FIG. 16(*b*) shows the cross sectional structure of the same.
Figure 16B:
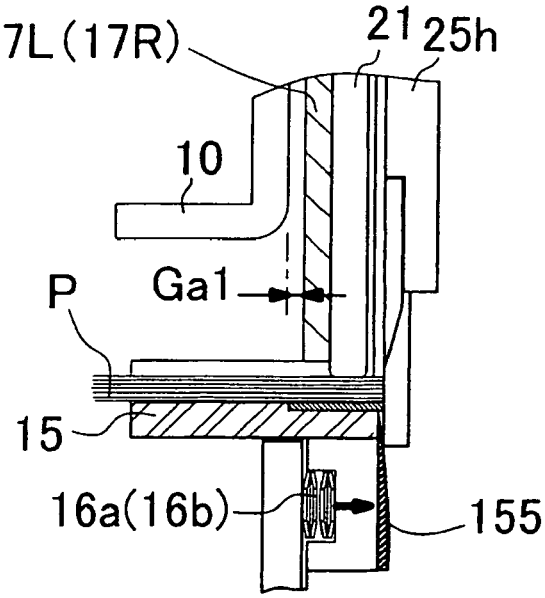

When gradually cutting the paper sheet P by means of the moving cutter edge 25 along the cutting-plane line CL from one end Pa toward the other Pz, the sheet loading table unit 15U is advanced or retreated in company with moving of the cutting point op. This structure will be explained. FIGS. 14(*a*) and 14(*b*) show a case of moving in parallel the sheet loading table unit 15U by means of a cam means (an inclined cam surface) 151. FIG. 15 shows a case of moving in parallel the sheet loading table unit 15U by means of guide grooves 152. FIG. 16 shows a case of rotationally moving the sheet loading table unit 15U by means of a cam means 153. Explanations will be made subsequently.

The sheet loading table unit 15U shown in FIGS. 13(*a*) to 14(*b*) is movably supported in the paper sheet surface at a cutting open 12 of the base plate 10 as mentioned above. The sheet loading table unit 15U integrally has the pair of left and right guide members 17R, 17L. Between the guide members 17R, 17L and base plate 10, there is provided urging means 16 (16*a*, 16*b*) composed of a compression spring. By the urging means 16 (16*a*, 16*b*), the sheet loading table unit 15U is always urged toward the moving cutter edge 25. Therefore, between the sheet loading table unit 15U and the moving cutter edge 25, the inclination cam face 151 is provided so that the paper sheet P on the sheet loading table unit 15U is moved in parallel. The inclination cam face 151 is arranged to the side of the cut-starting position (the left side in FIG. 2) of the moving cutter edge 25, so that it slides with the lower end 25*z* of the edge receiving holder 25*h* of the moving cutter edge 25.

The inclination cam face 151 is, as shown in FIG. 2, provided at a left guide member 17L as sling with the lower end 25*z* of the edge receipt holder 25*h*, and it is not provided at a right guide member 17R. The moving cutter edge 25 inclining at the fixed angle ($\alpha$) in the cutting direction is lower at the left side in FIG. 2, and higher at the right side, and the inclined cam face 151 is arranged at the left guide member 17L. The inclination cam face 151 is formed such that, as shown in FIG. 13(*a*), when being at the cutting point op1, the sheet loading table unit 15U is positioned at Cy1, when at the cutting point op2, the sheet loading table unit 15U is positioned at Cy2, and at the cutting point op3, the sheet loading table unit 15U is positioned at Cy3.

Accordingly, the paper sheet P set on the sheet loading table 15 retreats together with the sheet loading table unit 15U. In such a way, the inclination cam face 151 positionally moves the sheet loading table unit 15U in cooperation with moving of the cutting point op along the cutting line CL. In this case, the sheet loading table unit 15U and the pressure plate 21 acting on the paper sheet also positionally move by the same amount in the sheet surface direction, and this moving is obtained by rattling (clearance) in relation with the above mentioned pressure spring 18. In short, as shown in FIGS. 13(*a*) and 13(*b*), a gap Ga is formed between the base plate 10 and the sheet loading table unit 15U, and this gap Ga is formed in Ga1 at an initial period of cutting the paper sheet (the condition (a) in the same), and is formed in Ga2 at an ending period of cutting the paper sheet (the condition (b) in the same), and this gap is set to be Ga1>Ga2.

Next, explanation will be made to the structure of advancing or retreating the sheet loading table unit 15U shown in FIG. 15 with respect to the paper sheet surface. The sheet loading table unit 15U has the structure of moving in parallel by the guide grooves 152 formed in the apparatus frame (the above mentioned base plate) 10. The base plate 10 is formed with the guide grooves 152 for fitting and supporting the sheet loading table unit 15U, and the guide grooves 152 are disposed in the same direction as the paper sheet surface, and are arranged with slide rollers 152*a* fixed to the bottom of the sheet loading table unit 15U.

Accordingly, the sheet loading table unit 15U is supported to positionally move in a parallel posture along the guide grooves 152. The pressure plate 21 moves in the direction of the paper sheet surface (the Y direction) under the condition where the pressure plate 21 is fittingly mounted in the guide members 17R, 17L of the sheet loading table unit 15U. The pressure spring 18 disposed between the pressure plate 21 and the base plate 10 is whirled, following the moving of the pressure plate 21.

Next, explanation will be made to the structure of advancing or retreating the sheet loading table unit 15U shown in FIGS. 16(*a*) and 16(*b*) with respect to the paper sheet surface. The sheet loading table unit 15U has the structure where the sheet loading table unit 15U is rotatably pivoted to the apparatus frame (the above mentioned base plate) 10, and is rotated, following the moving of the cutting point op from one end Pa to the other Pz by the moving cutter edge 25. The sheet loading table unit 15U rotates by a pivot 153 to the apparatus frame (the above mentioned base plate). The sheet loading table 15 is furnished with the inclination cam face 155 and engages the holder 25*h* of the moving cutter edge 25, so that the sheet loading table unit 15U rotates around the pivot 153. Therefore, when cutting the paper sheet P with the moving cutter edge 25 composed as mentioned above as moving from one end Pa to the other Pz, the sheet loading table 15 rotates around the pivot 153 following the cutting point op. Thereby, the paper sheet P is cut linearly along the cutting-plane line.

In the present invention, concerning the moving cutter edge 25 and the stationary cutter edge 28, the explanation has been made to the case that when inclining one at the fixed angle (β) with regard to the other, the stationary cutter edge 28 is placed to meet the cutting-plane line CL and the moving cutter edge 25 is inclined at the angle (β), so that the moving cutter edge 25 and the stationary cutter edge 28 cross with each other. As a method different from the above mentioned, it is enough that the invention places the moving cutter edge 25 to meet the cutting-plane line CL so that the stationary cutter edge 28 is inclined at the angle (β).

Further, in the invention, the moving cutter edge 25 and the stationary cutter edge 28 are so formed that the edges of the blades draw the straight line, but it is also sufficient one of the moving cutter edge 25 and the stationary cutter edge 28 is so formed to be curved in order to draw curves a fixed curvature.

[Different Structure of the Moving Cutter Edge]

Figure 17:
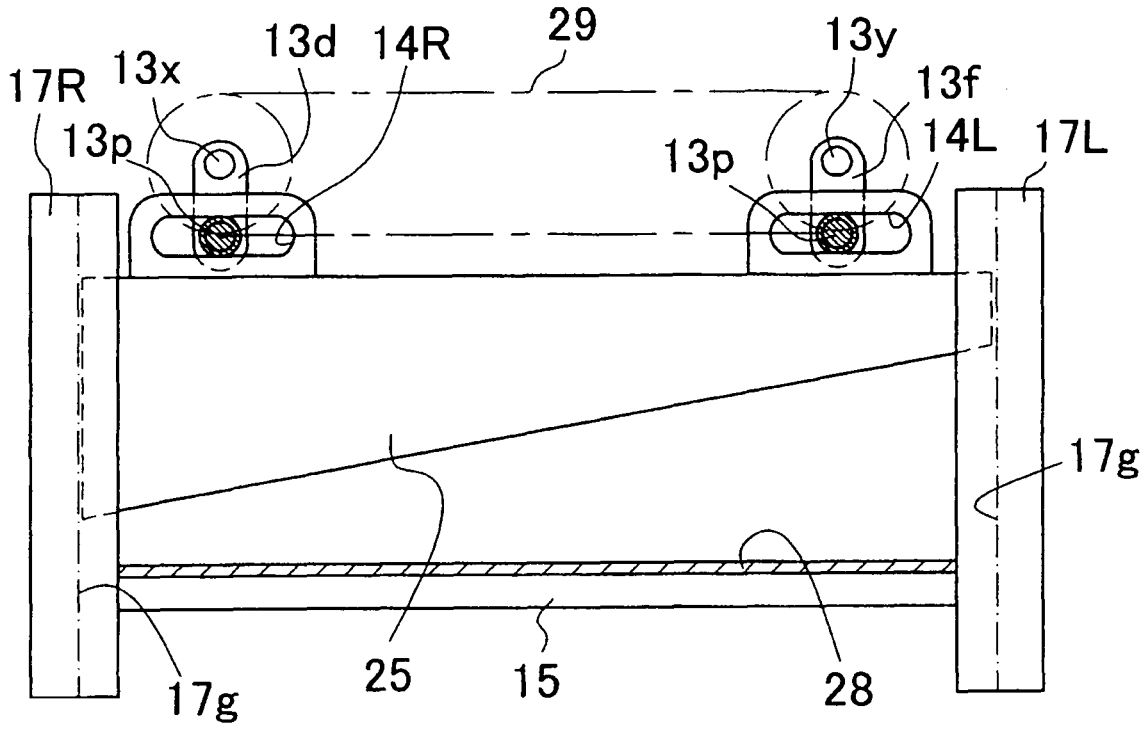
FIG. 17 is an explanatory view showing the different structure of the cutting apparatus from that of the apparatus of FIG. 2.

In the invention, it is possible to structure the moving cutter edge as follows. The above mentioned moving cutter edge 25 shown in FIG. 2 moves down as whirling by means of the pair of left and right drive rotation members 13*d*, 13*f*, but it is enough to structure the moving cutter edge 25 as shown in FIG. 17 to vertically move in a perpendicular direction to the paper sheet P. As to the structure as that of FIG. 2, the same marks are given to omit explanation, and the structure of FIG. 17 is supposed to cause the moving cutter edge 25 to be fitted in the guide grooves 17*g* formed in left and right guide members 17R, 17L in order to vertically move in the perpendicular direction. The pair of left and right drive rotation members 13*d*, 13*f* cause transmission pins 13*p* to be fittingly mounted in oblong bearings 14R, 14L. Accordingly, by the drive rotation members 13*d*, 13*f*, the moving cutter edge 25 vertically move only in the perpendicular direction. Other structures are similar to those of FIG. 2.

[Structure of the Image Forming Apparatus]

Next explanation will be made to a post-treatment apparatus having the above mentioned paper sheet cutting apparatus A and an image forming apparatus with reference to FIGS. 14(*a*) and 14(*b*). As the image forming apparatus B, various kinds of structures such as copiers, printers or printing machines may be employed, and an electrostatic printing machine is illustrated. The image forming apparatus B stores within a casing 51 a sheet supply part 52, printing part 53, sheet discharge part 54 and control part. The sheet supply part 52 is prepared with a plurality of cassettes corresponding to sheet sizes, and sheets of sizes instructed from the controller are sent into a sheet path 55. The sheet path 55 is furnished with resist rollers 55*a* for sending the paper sheet to the printing part 53 of a downstream side at a fixed timing after having performed a front end-justification.

The printing part 53 is furnished with an electrostatic drum 53*a* around which a printing head 53*b*, developing machine 53*c* and transcription charge 53*d* are disposed. The printing head 53*b* is composed of, for example, such as a laser emitter, forms an electrostatic latent image on the electrostatic drum 53*a*, causes a toner ink to adhere to the latent image by the developing machine 53*c*, and prints on the sheets by the transcription charge 53*d*. The printed sheet is fixed by a fixing unit 56 and delivered into a sheet discharge path 54*b*. The sheet discharge part 54 is provided with a sheet discharge open 58 and a sheet discharge rollers 59 formed in the casing 51. The printing sheet formed with images is delivered from the sheet discharge open 58 by the sheet discharge rollers 59.

Numeral 45 is a scanner unit which optically reads document images printed by the printing head 53*b*. A structure is, as publicly known, composed of a platen 46 loading and setting the document sheets, a carriage 47 for scanning the document images and an optically reading means (e.g., CCD device) 48 photoelectrically conversing optical images from the carriage 47. The illustrated apparatus is furnished on the platen 46 with a document feed apparatus 49 for automatically sending the document sheets to the platen 46.

[Structure of the Binding Apparatus]

Figure 18:
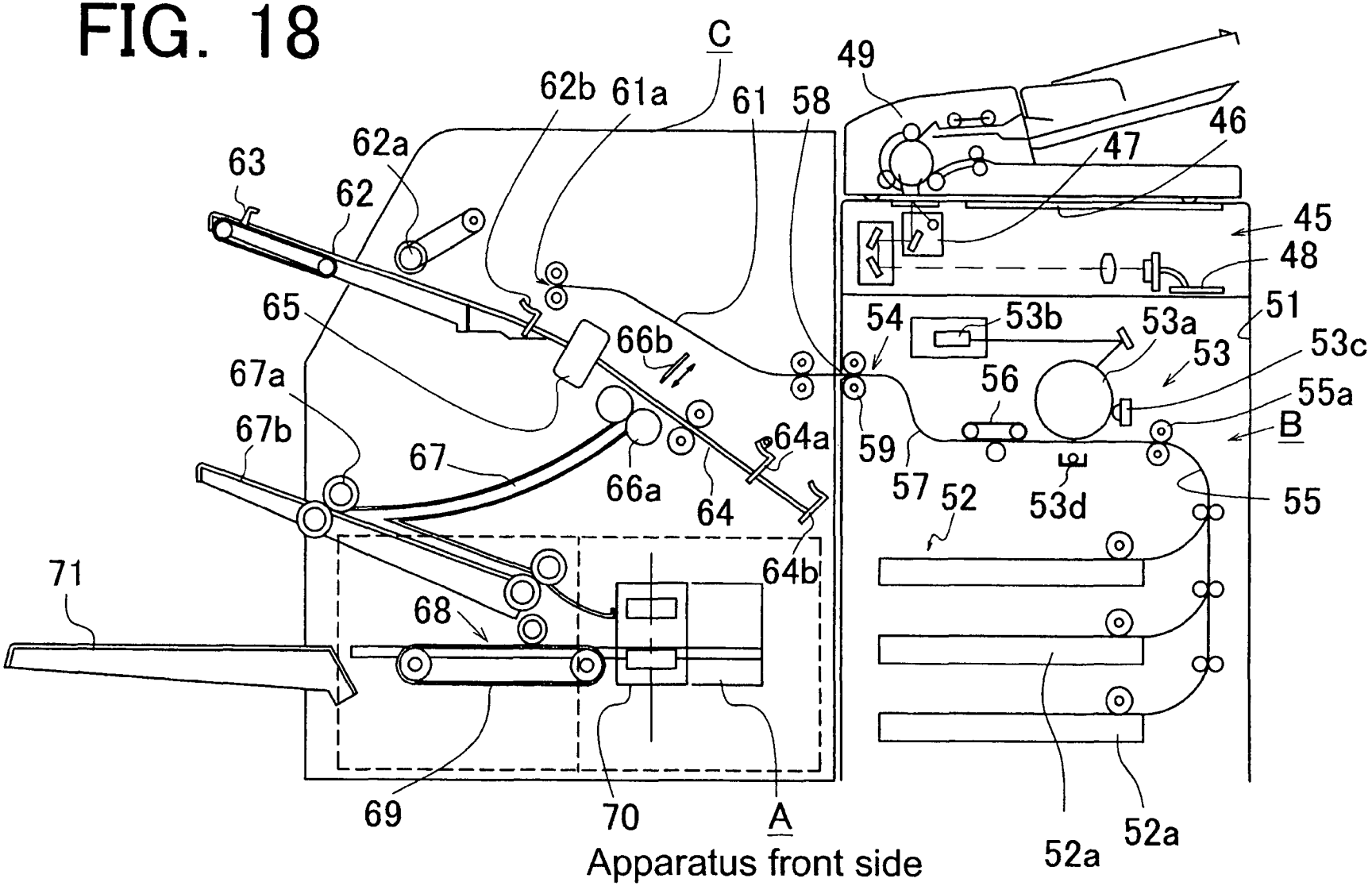
FIG. 18 is an explanatory view of the structure of the finisher apparatus storing therein the sheet stack cutting apparatus according to the present invention.

A binding apparatus C is connected to the downstream side of the image forming apparatus B, and the sheets formed with images are performed with the setting-justification shaped in stock. The paper sheet of the set-justification in stock is treated with binding by staples, adhesive tapes, adhesives and others. The paper sheet after the binding is performed with the cutting-justification by the above mentioned paper sheet cutting apparatus A and is stored in the discharging stacker. A binding apparatus C shown in FIG. 18 performs a staple binding at a center of the paper sheet of the set-justification in stock, and the centrally bound paper sheet is folded into a booklet, and after then, the folded booklet is cut at its front end.

The image forming apparatus B is provided with a bringing-in path 61 continuing to the sheet discharge opening 58, and an accumulation tray 62 is placed at the downstream side of the sheet discharge opening 61*a* of the bringing-in path 61. This tray is equipped with a switch back 62*a* for sending the sheets in the sheet discharging direction and a rear end regulating member 62*b* for regulating the sheet at its rear end. The switch back 62*a* delivers the sheet from the sheet discharge open 61*a* to the tray front end in the sheet discharging direction, and after the sheet rear end advances on the tray, the switch back 62*a* delivers the sheet in a reverse direction to the discharge direction and causes the sheet to collides with the rear end regulating member 62*b* for positioning. The rear end regulating member 62*b* turns between a position projecting from the tray and a position retreating from the tray, and is connected to a shift means (not shown) such as an electromagnetic solenoid. The accumulation tray 62 has a rear end pushing member 63 for delivering the accumulated sheet stack to the downstream side. The accumulation tray 62 has a side regulating member (not shown) for positioning to regulate a direction crossing with delivering of the sheet. Therefore, the sheet from the sheet discharge opening 61*a* is delivered onto the tray, and is accumulated in stack under the condition of regulating the sheet rear end to the rear end regulating member 62*b*. After then, the sheet stack is delivered to the downstream side by the rear end pushing member 63 under the condition that the rear end regulating member 62*b* retreats from the accumulation tray 62.

At the downstream side of the accumulation 62, a binding path 64 is continued, and in this binding path 64, a centrally binding stapler 65 is arranged. A structure of the centrally binding stapler 65 is not stated in details, but is made of a unit where a staple needle is pierced into the sheet stack and bent at its front end. An upper unit of piercing the staple needle and a lower unit of bending it are disposed up and down, holding the binding path 64 therebetween. The binding path 64 is provided with a 1st stopper 64*a* and a 2nd stopper 64*b* for catching the front end of the sheet stack. The 1st stopper 64*a* is composed with a material appearing on and disappearing from the binding path 64, and brings the centrally binding stapler 65 to position at the center of the sheet stack. Therefore, the sheet stack accumulated on the accumulation tray 62 is move to the binding path 64 by the rear end pushing member 63, and is bound by the centrally binding stapler 65 under a condition its front end is caught by the 1st stopper 64*a*.

As mentioned above, the centrally bound sheet stack is caught by the 2nd stopper 64*b* in the downstream side after the 1st stopper 64*a* retreats from the binding path 64. A bending roll 66*a* and a centrally bending knife 66*b* are disposed to bend the center (the staple binding position) under this condition. The centrally bending knife 66*b* is composed of a blade vertically movable in an arrow direction, and guides the sheet stack on the binding path to bending roll 66*a*. The bending roll 66*a* is composed of a pair of rolls to fold the center of the sheet stack and deliver to the sheet discharging path 67 of the downstream side.

The sheet discharging path 67 placed at the downstream side of the bending roll 66*a* is composed of a switch back path and guides the sheet to a cutting path 68. Numeral 67*a* designates a switch back roller, and 67*b* is an intermediate tray. The cutting apparatus A is placed in the thus composed cutting path 68. This cutting apparatus A is that explained in FIG. 1, and working will be later mentioned. The cutting path 68 is arranged with a belt transferring means 69 for transferring the sheet stack and a grip rotation means 70.

In the above structure, the sheets formed with images by the image forming apparatus B are accumulated in stock and regulated on the accumulation tray 62. When a control CPU (not shown) installed in the binding apparatus C receives a job finishing signal from the image forming apparatus B, the rear end regulating member 62*b* is retreated out of the tray, and the rear end pushing member 63 moves the sheet stack to the binding path 64 at the downstream side. The sheet stack is caused to collide at its front end with the 1st stopper 64*a* in the binding path. Under this condition, the centrally binding stapler 65 is actuated to carry out the staple binding at the center (the central bending position) of the sheet stack. Subsequently, the control CPU retreats the 1st stopper 64*a* out of the path and causes the sheet stack to collide with the 2nd stopper 64*b* at a further downstream side to stop it. Then, the center (the staple binding position) of the sheet stack faces the bending roll 66*a*, and under this condition, the centrally bending knife 66*b* is moved in the arrow direction. The sheet stack is guided to the bending roll 66*a* as being bent at the center. When the bending roll 66*a* is rotated, the sheet stack is bent at its center and moved to the sheet discharging path 67 at the downstream.

Figure 10:
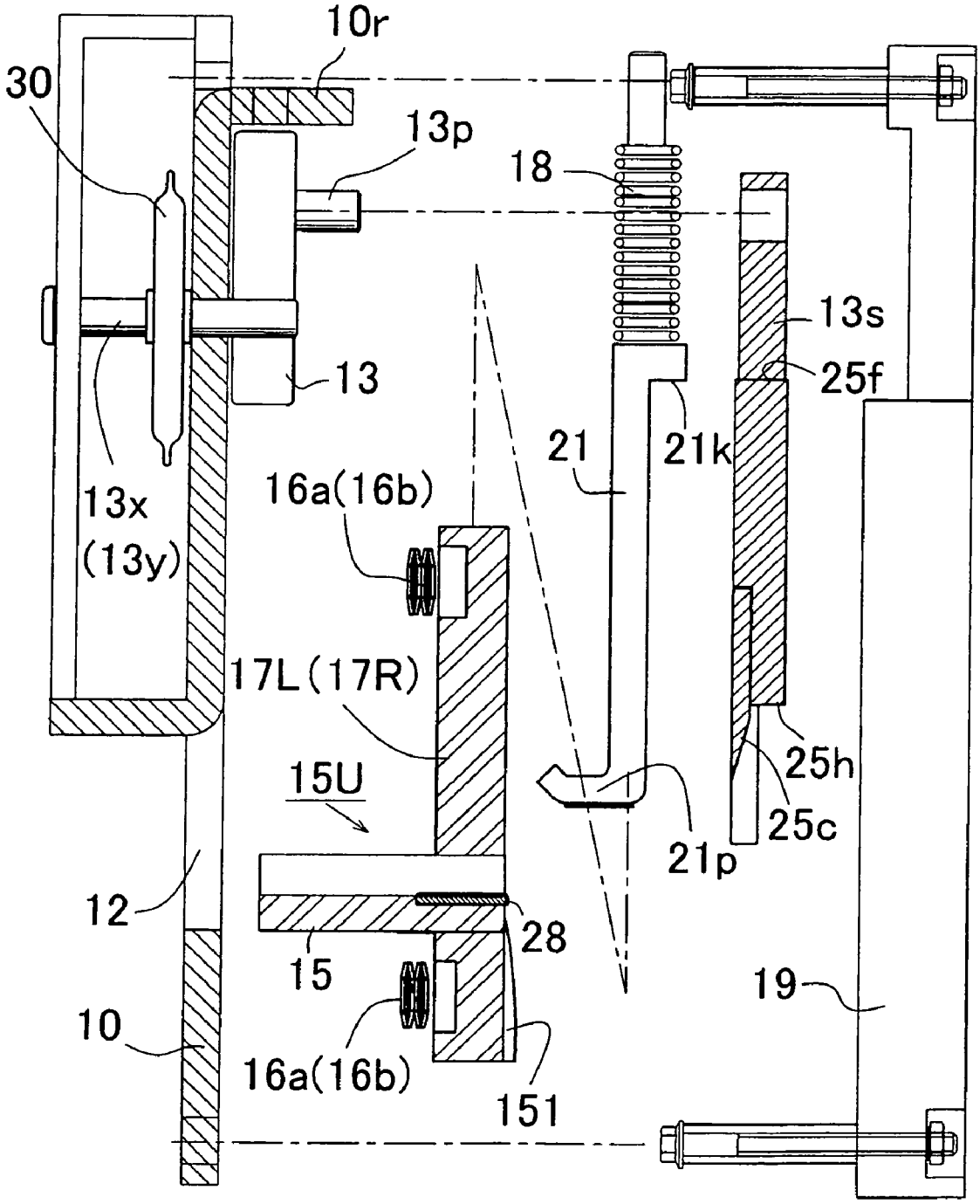
FIG. 10 is an explanatory view of assembling and disassembling the positioning structure of the stationary cutter edge and the moving cutter edge of the apparatus of FIG. 1.

The sheet stack thus guided in the sheet discharge path 67 turns reversely the delivery direction and is sent to the cutting path 68. In the cutting path 68, the sheet stack is switched back by the belt delivery means 69 to position the front end. As to positioning of the front end, under the condition of retreating the moving cutter edge 25 to the waiting position, the sheet stack is delivered to the right side of FIG. 10 to advance the whole of sheet stack into the cutting path 68. Then, the sheet stack is positioned such that the sheet stack is made go back to the left side of the same by the belt delivery means 69 and the determined cutting-plane line CL meets the position of the cutter edge. Subsequently, the control CPU nips the sheet stack by means of a grip rotation means 70, and the press means 20 presses to hold the sheet stack. Then, the moving cutter edge 25 is moved in the determined direction. Under this cutting condition, the sheet stack is cut at its end in the sequence explained previously in FIGS. 7(*a*) to 8(*c*).

After cutting the end of the sheet stack, the control CPU releases the press means from pressing, and actuates the grip rotation means 70 to rotate the sheet stack, e.g., 90 degrees and causes its top to face the cutting position. After rotation of the sheet stack, the sheet stack is sent to the cutting-plane line CL by the fixed amount. Sending of the sheet stack is carried out by moving the grip rotation means 70 to the right side or by the belt delivery means 69. After cutting the top of the sheet stack, the end part is cut similarly. When finishing to cut the sheet stack in the three directions, the control CPU delivers the sheet stack to the sheet discharge stacker 71 by means of the belt delivery means 69.

By the way, the binding apparatus C has been shown in the case of binding by the centrally binding stapler 65, but it is of course sufficient to coat an adhesive the end of the sheet stack for wrapping with surface sheets (wrap-binding), otherwise adhering on the top without wrapping with the surface sheets.

While the invention has been explained with reference to the specific embodiments of the invention, the explanation is illustrative and the invention is limited by the appended claims.

The disclosures of Japanese Patent Applications No. 2007-340847 filed on Dec. 28, 2007, No. 2008-027058 filed on Feb. 6, 2008, No. 2008-027059 filed on Feb. 6, 2008, No. 2008-027060 filed on Feb. 6, 2008, No. 2008-027061 filed on Feb. 6, 2008, No. 2008-040382 filed on Feb. 21, 2008 and No. 2008-050540 filed on Feb. 29, 2008 are incorporated herein as references.

What is claimed is:

1. A sheet stack cutter for cutting sheet stacks by means of a moving cutter edge and a stationary cutter edge disposed upward and downward along a predetermined cutting-plane line, comprising:

a sheet loading table for supporting the sheet stack, a press means for pressing and holding the sheet stack on the sheet loading table, a moving cutter edge disposed in a manner of moving in up and down cutting directions for cutting the sheet stack on the sheet loading table along the cutting-plane line, a stationary cutter edge disposed to the side of the sheet loading table for pressing the moving cutter edge to cut the sheet stack, a drive means for moving the moving cutter edge in up and down cutting directions, and an apparatus frame furnished with the press means and the moving cutter edge, wherein the press means is composed of a pressure member for pressing the sheet stack on the sheet loading table, a pressure spring for urging the pressure member to the side of the sheet stack, and a pressure releasing means for retreating the pressure member above the sheet loading table, the stationary cutter edge is supported to the apparatus frame movably back and forth in a plane direction of the sheet loading table substantially crossing with the vertically cutting directions of moving the moving cutter edge, and an urging means suppresses the stationary cutter edge to the side of the moving cutter edge, and the pressure member and the stationary cutter edge are disposed such that pressure of the pressure member by the pressure spring acts on the stationary cutter edge, and the stationary cutter edge is restrained from moving in the direction crossing with cutting by pressure of the pressure member.

2. The sheet stack cutter for cutting sheet stacks as set forth in claim 1, wherein the stationary cutter edge is secured integrally to the sheet loading table, the stationary cutter edge and the sheet loading table are supported by the apparatus frame movably back and forth in the plane direction of the sheet loading table on the sheet loading table.

3. The sheet stack cutter for cutting sheet stacks as set forth in claim 1, wherein the moving cutter edge and the stationary cutter edge have the edges of the blades inclining at a predetermined angle one to the other in the vertically cutting directions, such that the sheet loading table gradually cut the sheet stack from one end to the other end along the cutting-plane line.

4. The sheet stack cutter for cutting sheet stacks as set forth in claim 3, wherein the moving cutter edge and the stationary cutter edge are disposed to incline at a predetermined angle one to the other in a manner of both crossing with cutting-plane line each other, and a shift means is provided to move the sheet loading table in a sheet surface direction for gradually cutting the sheet stack on the sheet loading table by the moving cutter edge from one end to the other.

5. The sheet stack cutter for cutting sheet stacks as set forth in claim 4, wherein the shift means has a cam member which moves in parallel in the sheet surface direction, following the moving of the cutting direction of the moving cutter edge.

6. The sheet stack cutter for cutting sheet stacks as set forth in claim 1, wherein the moving cutter edge and the pressure member are disposed to respectively move vertically at predetermined strokes with respect to the apparatus frame, the moving cutter edge is connected to a drive means having a drive motor vertically moving between a waiting position separating from the sheet stack on the sheet loading table and a cutting position cutting the sheet stack, the pressure member has the pressure spring in relation with the apparatus frame to press the sheet stack on the sheet loading table, and the pressure member is engaged with the moving cutter edge from the actuating position pressing the sheet stack on the sheet loading table, following the moving cutter edge, to the waiting position separating above of the sheet stack.

7. The sheet stack cutter for cutting sheet stacks as set forth in claim 1, wherein the apparatus frame is composed of a base plate disposed in the direction substantially crossing with the sheet stack on the sheet loading table, and the pressure plate disposed separately from the base plate, the pressure member and the moving cutter edge are respectively supported as vertically movable between the base plate and the pressure plate, the base plate is provided with a pair of drive rotation arms connected to the drive motor, and the moving cutter edge is connected to the drive rotation arms as vertically movable in the cutting direction.

8. The sheet stack cutter for cutting sheet stacks as set forth in claim 7, wherein the pair of drive rotation arms are disposed with a movement restraining means for restraining the pressure member from moving down by action of the pressure spring under a condition stopping the drive motor.

9. A finisher apparatus, comprising:

the sheet stack cutter as set forth in claim 1, a tray means for accumulating in stacks sheets successively supplied, a stack binding means for binding the sheet stack from the tray means, and a sheet stack cutter for cutting the sheet stack bound by the stack binding means.

* * * * *